United States Patent [19]

Zhilikov et al.

[11] 4,407,017

[45] Sep. 27, 1983

[54] METHOD AND APPARATUS FOR CONTROLLING DRILLING PROCESS

[76] Inventors: Valentin V. Zhilikov, poselok Malakhovka, Bykovskoe shosse, 35, kv. 5, Moskovskaya oblast; Boris I. Motsokhein, B.Cherkizovskaya ulitsa, 9, korpus I, kv. I52; Boris M. Parfenov, B.Cherkizovskaya ulitsa, 9, korpus I, kv. I32, both of, Moscow, all of U.S.S.R.

[21] Appl. No.: 331,998

[22] Filed: Feb. 18, 1981

[30] Foreign Application Priority Data

Sep. 6, 1978 [SU] U.S.S.R. ..... 2652601

[51] Int. Cl.[3] ..... G06F 15/46

[52] U.S. Cl. ..... 364/420; 175/24; 364/149; 173/6

[58] Field of Search ..... 364/420, 149-151, 364/474, 506, 507, 550, 551, 421, 422; 175/24-27, 38-40, 45, 48, 50; 173/4-9, 20, 21; 73/151, 151.5, 152-155, 104, 105

[56] References Cited

U.S. PATENT DOCUMENTS

| | | | |
|---|---|---|---|
| 3,752,966 | 8/1973 | Foy, Jr. et al. | 364/420 |
| 3,971,449 | 7/1976 | Nylund et al. | 175/27 |
| 4,165,789 | 8/1979 | Rogers | 364/420 X |

OTHER PUBLICATIONS

A. A. Pogarsky, Automation of Deep Well Drilling Process, Nedra Publ., 1972.

Data Monitoring on Today's Rig, The Oil and Gas Journal, 9/24/73. Well-site Analysis Headed for Economy, New Capabilities, The Oil and Gas Journal, Sep. 24, 1973.

Computerized Drilling Control, Journal of Petroleum Technology 4/69.

*Primary Examiner*—Joseph F. Ruggiero

*Attorney, Agent, or Firm*—Lilling & Greenspan

[57] ABSTRACT

A method for controlling drilling process based on the use of an adaptive model of drilling process comprises two control modes of which one is a multicycle rock formation trial mode and the other mode is a drilling mode proper. During the first cycle of the trial mode the drilling speed is determined on the basis of pre-set values of controlled parameters and approximate values of coefficients of the adaptive model being corrected and this drilling speed is compared to the value of drilling speed as measured during the first cycle; and corrected values of a respective coefficient of the adaptive model being corrected are formed based on the comparison results; and, taking into account these values, the values of control signals close to optimum values are determined which are the settings for acting on the bit during the next trial mode cycle. In each next cycle the corrected coefficients of the preceding cycle are used for determining control signals. If the measured drilling speed coincides with the computed drilling speed in two consecutive cycles, the control signal formed during these cycles is the signal to be used in the drilling mode proper. Also disclosed is an apparatus for effecting the above-described method, which includes a control board, actuating mechanisms of a drilling rig, pick-ups for sensing drilling speed, bit load and bit rotary speed, and an electronic computer storing the adaptive model of drilling process.

50 Claims, 15 Drawing Figures

METHOD AND APPARATUS FOR CONTROLLING DRILLING PROCESS

FIELD OF THE INVENTION

The invention relates to drilling technology and, more particularly, it deals with methods and apparatus for controlling drilling process.

The invention may be used in drilling wells, e.g. for drilling oil and gas production wells.

BACKGROUND OF THE INVENTION

Mechanical breaking of rocks, such as in drilling oil and gas wells, is associated with the need to set control signals (for load on rock breaking tool—drill bit and its rotary speed) depending on the lithologic type of the rock being drilled (hardness, abrasiveness, plasticity) and other specific conditions in which the production process occurs. Some of the factors influencing the drilling process may be considered unchanged during the run (drill bit life), others change during the run, and it should be noted that while the trend to the bit bearing wear and bit tooth wear with time is obvious, occurrence of non-uniformity and other lithologic deviations in rock is unpredictable. In practice, determination of control signals is associated with a continuous monitoring of the process and depends on the current condition of bit and rock being drilled independent of the drilling method—turbodrilling, rotary drilling or electrodrilling. It should be noted that no direct methods for monitoring the bit wear and changes in rock properties exist.

Description of the Prior Art

Known in the art are various methods and apparatus for controlling drilling process which may form non-automated and automatic systems.

In non-automated systems the selection of control signals is effected on the basis of previous experience directly by the operator (driller). The productivity of drilling with such control method is on the average 25-30% lower than optimum productivity (cf. A. A. Pogarsky, Automation of Deep Well Drilling Process, Nedra Publ., 1972).

Such non-automated systems are used more frequently than automatic systems.

In automatic systems, an adaptive model of production process is used for forming control signals. Parameters of the bit and data on other factors that remain unchanged during the run are entered in the adaptive model before the run is started, from the control board. Parameters of the rock being drilled which are unknown before starting the drilling (or known only approximately) are determined during the drilling. The run time is divided into two periods—a rock trial period (drill rate testing) (correction of model parameters) with subsequent determination of optimum control signals and an optimum performance drilling period. The trial time constitutes the time of non-rational use of the tool and has an important effect on productivity in deep well drilling since the duration of drilling with one bit (footage per bit) materially decreases with an increase in the well depth. In addition, frequent changes in lithologic properties of rock are more likely to occur upon which the system is bound to turn back to the trial mode repeatedly during one run. Rational utilization of the bit life by improving control methods and apparatus is one of the basic directions on the way of improving the productivity of deep and ultradeep drilling rigs with any drilling method.

In known automatic control systems for a drilling rig communication between the operator and the drilling process through the intermediary of a computer is implied (cf. Kennedy J. L. Data Monitoring on Today's Rig, Oil and Gas Journal, 1973, V.71, No. 39, pp. 119-120, 125-126).

These systems cannot function in real time and do not involve on-line evaluation of the production conditions.

In such systems data from sensors installed at the rig is converted from analog to digital form, coded on a punched tape and transmitted via a telex to a computer center where a computer is switched-over at regular intervals for servicing a given rig, and the data is studied for correcting the drilling programs. The computed results are sent back to the rig by telex and are used by the operator in manipulating the controls of basic actuating mechanisms manually. Therefore, an active retrieval of information and on-line use of the results are not possible. A method for optimizing the drilling process using the criterion of minimum cost of one meter of drilling may be used in such automatic drilling rig control system (cf. Well-Site Analysis Handed for Economy. New Capabilities, Oil and Gas Journal, 1973, V.71, No. 39, p.132, 134, 136, 141).

Active retrieval and on-line use of data are also impossible with such a system so that well drilling time increases and high performance of the drilling rig cannot be achieved.

Known in the art is a method of controlling drilling process which is based on the employment of an adaptive model of drilling process used to form control signals acting on a drilling rig. The method comprises the use of two control modes—the mode of trial of a rock formation being drilled and the drilling mode proper.

With a multicycle trial mode each cycle includes setting the value of load on the bit (bit weight) and its rotary speed, measuring mechanical drilling speed corresponding to such values and forming control signals at the end of the cycle to be fed to appropriate actuators for the next cycle. Control signals are formed for the drilling mode proper based on the trial results. In case the values of controlled parameters, such as load on the bit and rotary speed of the bit in the last mode, differ from desired values, the drilling mode proper is changed for the trial mode (cf. Young F. S., Computerized Drilling Control, Journal of Petroleum Technology, April, 1969).

The prior art method is based on the solution of an equation for the cost of one meter of drilling to find out control signals ensuring optimization of such cost. The basis for obtaining such an equation is the following formula for drilling speed:

$$V = \frac{k(P - P_0)n^{\lambda}}{1 + C_z H}, \quad (1)$$

wherein

V is the drilling speed (or rate),

P is the load on the bit (bit weight) during drilling, $P_o$ is load on the bit (bit weight) extrapolated for zero drilling speed;

$C_z$ is the coefficient of bit quality;

H is the normalized bit tooth height;

K is the coefficient of drillability of rock formation drillability;

n is the rotary speed of the bit

λ is the coefficient of the effect of the rotary speed of the bit on the drilling speed.

For determining the values of K and λ which vary during the drilling, a standard trial program is used which is referred to as a "five-point method". The method basically consists in the following. During the first trial cycle arbitrary values of P and n are set and corresponding values of V are fixed by means of a memory; then the values of P and n are alternately changed (increased and decreased) during another four trial cycles, and the drilling speed is determined in each cycle.

Then a sixth trial cycle is conducted in which the values of P and n are set equal to those set during the first cycle, that is, there are five points of P and n altogether.

If the drilling speed V during the sixth cycle is the same as that in the first cycle, the trial mode is over. Subsequently the equation (1) is solved taking into account the measurement results from the memory, and the coefficients K and λ of the adaptive model are computed and corrected, and the corrected coefficients are put into the adaptive model and optimum signals for given drilling conditions are computed to be fed to actuating members of the drilling rig, whereafter the drilling rig is switched over for the drilling mode proper. Should the drilling speed of the sixth cycle differ from that of the first cycle, the trial mode is repeated.

The drilling mode with the control signals thus obtained continues as long as the measured drilling speed differs only slightly from the design speed. When the drilling speed deviates from the computed speed, the trial mode is used again.

An apparatus for carrying out the above-described method comprises a control board for controlling drilling process, which is coupled through a digital-to-analog signal converter to actuating mechanisms of the drilling rig. The apparatus has a computer storing an adaptive drilling process model, a unit for forming control signals in the trial mode and a unit for forming optimum control signals which have their outputs coupled to inputs of the digital-to-analog converter and inputs coupled to appropriate outputs of pick-ups, a memory and a timer.

Coupled to the computer are a mechanical drilling speed pick-up, a bit load pick-up and a drilling bit rotary speed pick-up; in addition, a unit for monitoring the values of coefficients of the adaptive model is also coupled to the computer (cf. Young F. S., Computerized Drilling Control, *Journal of Petroleum Technology*, April, 1969).

Initial values of the coefficients and initial values of control signals, as well as a command for starting the trial mode are fed to the adaptive model from the control board.

Commands for switching from one trial cycle to another are fed by the timer in accordance with a pre-set program, and control signals are formed by the trail mode control signal forming unit. After the trial mode is completed, the corrected values of the coefficients are put into the adaptive model in which optimum control signals to be fed to actuating mechanisms are formed.

The main disadvantage of the above-described method and apparatus is that the system effects different changes of a combination of control signals for adjusting bit load and bit rotary speed according to a preselected sequence so that no optimum combination of control signals may be achieved in any of the six trial cycles. If a combination of parameters in any cycle proves to be close to the optimum merely by chance, the prior art control system may not "sense" it and continues the performance of the pre-set trial program to lead the drilling conditions away from the optimum zone. As each of the six trial cycles lasts up to ten minutes, the trial mode takes a comparatively long time as a whole, and during this time the drilling bit operates under non-optimum conditions. Due to a long time of the trial mode, it is quite likely that the properties of the rock being drilling may change by the last trial cycle which will require repeating the trial mode with another six trial cycles, and the above-mentioned disadvantage becomes more pronounced.

A second serious disadvantage is that the control signals P and n remain unchanged after switching-over for the drilling mode, and, even with the unchanged properties of the rock being drilled, the difference between actual values of such signals and their optimum values gradually increases since optimum values change as a result of natural bit wear. The consequene of this disadvantage is that the drilling speed, which is comparatively rapidly measured, differs from the computed drilling speed so that the trial mode is to be repeated with all above-mentioned disadvantages inherent therein.

Due to the above-mentioned disadvantages, the prior art method makes it possible to obtain optimum control signals only during a long-term drilling of one and the same rock formation and cannot ensure an efficient operation of a drilling rig due to a continuous drilling using non-rational parameters under frequent changes in properties of rocks being drilling during one run which is especially true with deep well drilling where the bit life is limited.

SUMMARY OF THE INVENTION

It is an object of the invention to provide a method and apparatus for controlling drilling process which enable a reduction of well drilling time with non-optimum values of control signals acting on actuating mechanisms of a drilling rig.

It is also an object of the invention to provide conditions for rational utilization of the drilling bit life.

Another object of the invention is to provide a method in which the accuracy of determination of coefficients of an adaptive model of productionn process is comparatively high.

Finally, it is an object of the invention to improve the productivity of a drilling rig, especially under the conditions of frequent changes of lithologic properties of the rock being drilled.

This is accomplished by a method for controlling drilling process, which is based on an adaptive model of drilling process, comprising two control modes of which one mode is a mode of trial of a formation of the rock being drilled and the other mode is the drilling mode proper. The rock formation trial mode is a multi-cycle mode wherein during each cycle values of control signals for drilling process are set, the drilling speed corresponding to the set values of control signals is measured and control signals are formed at the end of the cycle to be fed to respective actuating mechanisms of the drilling rig, and control signals are formed on the basis of the trial mode results to be used in the drilling mode proper and also a signal for changing over from the trial mode to the drilling mode proper is formed. If the controlled parameters of drilling process differ from the desired parameters, a change over is effected from the drilling mode proper to the trial mode again. According to the invention, the method also comprises determining, during the first cycle of the trial mode, the drilling speed on the basis of pre-set values of control signals and of the pre-set approximate values of the coefficients of the adaptive model to be corrected; comparing this drilling speed with the value of this speed measured during the same cycle; forming corrected values of respective coefficients of the adaptive model being corrected on the basis of the comparison results; using these coefficients to determine the values of control signals closest to optimum values, which are the settings for acting on the bit during the next trial cycle; and using the corrected coefficients from the foregoing cycle in each next cycle for determining control signals. The values of the control signals are determined by approximating those which are optimum for given drilling conditions upon a transition to each next cycle; and, when the measured drilling speed coincides with the drilling speed being determined in two successive control cycles, the signal formed during such cycles is regarded as the control signal to be used in the drilling mode proper.

An adaptive model of drilling process may be constructed on the basis of the following set of equations:

$$\ln V(N) = \sum_{i=1}^{l} k_i(N)\ln x_i + \sum_{j=1}^{m} x_j \ln k_j(N), \quad (2)$$

wherein

N is the cycle number,

V(N) is the computed value of drilling speed (or rate) in the Nth cycle, $k_i$ and $k_j$ are the coefficients of the adaptive model being corrected which correspond to control signals, $x_i$ and $x_j$ are the values of control signals, i and j are the numbers of control signals. The corrected values of respective coefficients are corrected being determined by the formulae:

$$k_i(N) = k_i(N-1) + \mathrm{sign}[\ln V(N) - \ln V]\frac{\alpha \ln x_i}{\sum_{i=1}^{l}(\ln x_i)^2 + \sum_{j=1}^{m} x_j^2}; \quad (3)$$

$$k_j(N) = \exp\left\{\ln k_j(N-1) = \mathrm{sign}[\ln V(N) - \ln V]\frac{\alpha x_j}{\sum_{i=1}^{l}(\ln x_i)^2 + \sum_{j=1}^{m} x_j^2};\right\},$$

wherein

V is the measured value of the drilling speed (or rate), $\alpha$ is the coefficient depending on the difference in the measured and computed drilling speed values.

Control signals in the drilling mode proper are preferably caused to change stepwise in time during the drilling period, the regularity and the degree of change of the signals being determined with the help of the adaptive model in such a manner that the signals should remain close to optimum values, taking into account the bit bearing wear and the bit tooth wear during the drilling.

For correcting the coefficients of the adaptive model in the drilling mode proper, these coefficients may be determined in accordance with pre-set control signals and values of drilling speed obtained for specific drilling conditions.

Upon a change in the drilling conditions, a change over from the drilling mode proper back again to the trial mode should be effected, and the coefficients of the adaptive model obtained at the moment of completion of the drilling mode proper should be taken as the initial values of the coefficients of the first re-trail mode cycle which are to be corrected.

The control signals are preferably the load on the bit (bit weight) and rotary speed of the bit.

The objectives are also accomplished by an apparatus for controlling drilling process, comprising a control board for controlling drilling process which is coupled through a digital-to-analog converter to actuating mechanisms of a drilling rig; a drilling speed pick-up; a bit load pick-up; a bit rotary speed pick-up; a computer storing an adaptive model of drilling process which is coupled to the bit load pick-up, bit rotary speed pick-up, drilling speed pick-up and to the control board, and which has a unit for forming optimum control signals, having its output coupled to inputs of the digital-to-analog converter and inputs coupled to respective outputs of a timer and of bit load and bit rotary speed pick-ups; and a unit for monitoring the values of parameters coupled to the computer. The timer is also coupled to the control board. According to the invention, the apparatus also comprises a unit for discretely averaging the drilling speed, having its inputs coupled to the drilling speed pick-up and to the timer output. The computer comprises a unit, for sequentially entering data from the control board, having its inputs coupled to the control board; a unit, for determining corrected values of coefficients of the adaptive model, having its inputs coupled to the output of the discrete averaging unit and to outputs of the unit for sequentially entering data; a first memory having its inputs coupled to outputs of the unit for determining corrected values of the coefficients and outputs coupled to the inputs of the same unit and to inputs of a unit for monitoring values of parameters being corrected; a second memory having its inputs coupled through a data transfer unit to respective outputs of the first memory; a unit for forming parameters of drilling process having its inputs coupled to outputs of the unit for monitoring values of parameters and outputs coupled to the input of the data transfer unit, and a unit for correcting coefficients of the adaptive model having its inputs coupled to outputs of the second memory and to outputs of the unit for forming parameters of drilling process and outputs coupled to respective inputs of the unit for forming optimum control signals.

The unit for forming optimum control signals may comprise a unit for determining the type of the bit wear in which a first group of inputs are coupled to the outputs of the timer and to the outputs of the bit load pick-ups and of the bit rotary speed pick-ups and a second group of inputs are coupled to the outputs of the control board; a unit for computing optimum settings, if case the bit wear consists in the wear of its seat (or bearing), having its inputs coupled to the output of the unit for determining the type of the bit wear, to the timer output and to the control board and also coupled to the output of the unit for correcting coefficients and to the output of the unit for monitoring values of parameters; a unit for computing optimum settings, if the bit wear consists in the wear of its inserts (teeth), having its inputs coupled to the output of the unit for determining the type of the bit wear and to the outputs of the control board and also coupled to the outputs of the unit for correcting coefficients and to the output of the unit for monitoring values of the coefficients being corrected; and a switching circuit comprises two groups of switch members, each being coupled to the outputs of the units for computing optimum settings for the bit wear consisting in the wear of its seat (bearing) and in the wear of its inserts (teeth), respectively, and, via respective AND gates, to the outputs of the unit for determining the type of the bit wear and to the timer, and two adder members having their inputs coupled to the outputs of the two groups of the switch members, respectively, the outputs of the adder members being the otuputs of the unit for forming optimum control signals at which control signals are formed to control the actuating mechanisms of the drilling rig.

The unit for monitoring values of the parameters preferably comprises a functional circuit for raising to power having its inputs coupled to the bit rotary speed pick-up and to a respective output of the first memory; a first signal multiplying circuit having its inputs coupled to the bit load pick-up and to a respective output of the first memory; and a second signal multiplying circuit having its inputs coupled to the output of the first multiplying circuit and to the output of the functional circuit for raising to power and an output coupled to a first input of a dividing circuit. The dividing circuit has a second input to which is coupled an output of an adder, having a first input coupled, via a variable resistor, to a source of a shift voltage and a second input coupled, via a third multiplying circuit, to a respective output of the unit for forming optimum control signals, the output of the dividing circuit being coupled to a respective input of the unit for determining corrected values of the coefficients and to a first input of a comparator. The comparator has its second input coupled to an output of the unit for discretely averaging the drilling speed and an output coupled, via a switching circuit, to a respective input of the unit for forming parameters of drilling process.

In a preferred embodiment the unit for sequentially entering data from the control board comprises a group of electronic switches, each having an input coupled to a respective code switch of the control board and a control input coupled to a respective on-off switch; and code-to-analog signal converters coupled to respective electronic switches. The unit for correcting the coefficients of the adaptive model comprises a group of electronic switches which have a common control input and are coupled to an input of the unit for forming a correcting signal which has a signal memory circuit; and a signal tracing circuit having their outputs which are outputs of the whole unit for correcting the coefficients of the adaptive model.

Further, the unit for determining corrected values of the coefficients of the adaptive model may comprise a circuit for correcting the coefficient corresponding to the drillability of the rock and an associated circuit for correcting the coefficient corresponding to the bit rotary speed, the inputs of each of these circuits receiving signals from the unit for sequentially entering data and from the first memory which are indicative of the values of the coefficients of the adaptive model during the foregoing cycle, and from the unit for discretely averaging the drilling speed and from the unit for monitoring values of the coefficients.

The unit for discretely averaging the drilling speed may comprise a circuit for comparing and reading the signal corresponding to the drilling speed from the envelope of the signal, the output of the circuit being coupled to an electronic switch having its control input coupled to the timer output and an output forming a signal for effecting the transfer of a signal corresponding to the averaged value of the drilling speed. The unit for forming parameters of drilling process may comprise an OR gate having its inputs, which are the inputs of the whole unit, coupled to respective outputs of the unit for monitoring values of the parameters; a first AND gate having its inputs coupled to respective outputs of the unit for monitoring values of the parameters; and a second AND gate having a first input which is combined with one of the inputs of the OR gate and a second input coupled to the output of the first AND gate; and, the outputs of the OR gate and of the second AND gate are the outputs of the whole forming unit.

The data transfer unit preferably comprises a set of switch members providing for putting corrected values of the coefficients of the adaptive model to the second memory.

It should be noted that each of the units for computing optimum settings for the bit wear consisting either in the wear of its seat (bearings) or in the wear of its inserts (teeth) may comprise an optimizer and a circuit for forming current wear of seat or inserts of the bit which is coupled to one of its inputs and has its inputs coupled to the timer and to the output of the unit of the type of the bit wear, the signals corresponding to optimum settings of the bit load and of its rotary speed in accordance with the current wear of the bit seat or inserts being formed at the output of the optimizer. The unit for determining the type of the bit wear may be made as a two-channel unit and each channel may be coupled to the input of its own switching circuit, second inputs of switching circuits being coupled to the timer. The first channel includes a first divider coupled with its inputs to the bit rotary speed pick-up and to the control board, and a non-linear member coupled to the input of the bit load pick-up, the outputs of the divider and of the non-linear member being coupled to the inputs of a first multiplying circuit which is coupled to the input of the switching circuit of the same channel; and, the second channel includes two series connected multipliers, the first multiplier having both inputs and the second multiplier having one input which are coupled to the bit rotary speed pick-up, and the output of the second multiplier being coupled, via a first adder and a second multiplying circuit coupled to the output of the first adder, to the first input of a second divider which has a second input to which are coupled, via a third multiplying circuit, a second adder having one input coupled to the control board and the second input coupled to the output of a fourth multiplying circuit which is coupled with its inputs to the bit load pick-up and to the control board, and a third adder having one input receiving a bias voltage and the other input coupled to the output of the fifth multiplying circuit having its inputs coupled to the control board and to the output of the unit for computing settings in case the bit wear consists in the wear of its inserts (teeth), the second input of the second multiplying circuit being coupled to the control board and the second input of the first adder being coupled to the bit rotary speed pick-up.

The circuit for correcting the coefficient corresponding to the drillability of the rock preferably comprises a first logarithm-computing circuit which is coupled to the output of the first memory and, via the first multiplying circuit, to the first input of a first adder, a second logarithm-computing circuit coupled to the output of the monitoring unit and to the output of the unit for discretely averaging the drilling speed; a third logarithm-computing circuit and a fourth logarithm-computing circuit coupled to the bit rotary speed pick-up, the second and the third logarithm-computing circuits being coupled to the inputs of a second adder which is coupled to a switching circuit having a first output which is coupled, via an inverter, and a second output which is coupled directly to the inputs of the first adder; and a fourth logarithm-computing circuit being coupled, via a second multiplying circuit and a third adder, to the first input of a divider having its second input coupled, via a third multiplying circuit, to the output of the first logarithm-computing circuit, and an output coupled to the input of the switching circuit, the second input of the third multiplying circuit being directly, and the second input of the third adder, via the fourth multiplying circuit, coupled to the output of the first logarithm-computing circuit, and the output of the first adder being coupled to the input of an antilogarithm-computing circuit having an output which is the output of the whole coefficent correcting circuit.

The circuit for correcting the coefficient corresponding to the rotary speed preferably comprises a first adder having one input which is coupled to the output of a first memory; a first logarithm-computing circuit coupled to the output of the unit for monitoring values of parameters; a second logarithm-computing circuit coupled to the output of the unit for discretely averaging the drilling speed; a third logarithm-computing circuit coupled to the bit rotary speed pick-up; and a fourth logarithm-computing circuit coupled to the output of the circuit for correcting the coefficient corresponding to the drillability of the rock. The first and the second logarithm-computing circuits are coupled, via a second adder, to the input of a switching circuit having one output which is directly coupled, and a second output which is coupled via an inverter, to other inputs of the first adder; the third logarithm-computing circuit is coupled, via a first multiplying circuit and a series circuit including a second multiplying circuit and a third adder, to two inputs of a divider having its output coupled to the second input of the switching circuit; and the fourth logarithm-computing circuit is coupled, via a third multiplying circuit, to a second input of the third adder, the second input of the first multiplying circuit being coupled to the output of the second adder, and the output of the first adder being the output of the whole coefficient correcting circuit.

BRIEF DESCRIPTION OF THE DRAWINGS

Other objects and advantages of the invention will become apparent from the following description of specific embodiments thereof with reference to the accompanying drawings, in which.

DETAILED DESCRIPTION OF THE INVENTION

Figure 1:
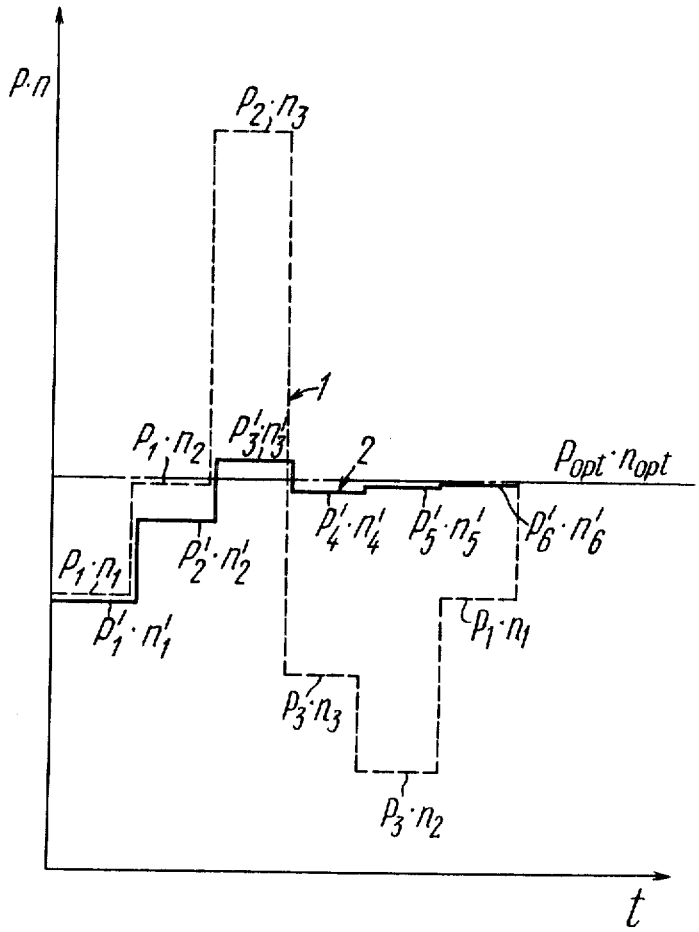
FIG. 1 is a graph showing variation of the product of controlled trial mode parameters in time.

The method for controlling a drilling process consists of two modes: a mode of trial of a rock formation being drilled and a drilling mode proper. The rock formation trial mode is a multicycle mode. The number of the trial mode cycles is not fixed. In each cycle of the trial mode the values of load on the tool (hereinafter referred to as a bit) and of the tool rotary speed are pre-set, and a drilling speed is measured which corresponds to said values of the load on the bit and its rotary speed.

After the cycle is completed, new control signals are formed which are fed to respective actuating mechanisms cooperating with the bit. For that purpose use is made of an adaptive mathematical model of the process which is represented in the following form:

$$\ln V(N) = \sum_{i=1}^{l} k_i(N)\ln x_i + \sum_{j=1}^{m} x_j \ln k_j(N),$$

wherein

N is the number of cycle;

V(N) is the value of drilling speed in the Nth cycle;

$k_i$ and $k_j$ are the coefficients of the adaptive model being corrected corresponding to the control signals;

$x_i$ and $x_j$ are the values of control signals;

i and j are the numbers of control signals.

For the first cycle, some approximate values are pre-set for the coefficients of the adaptive model $k_i$ and $k_j$ being corrected, wherein $k_j$ is the coefficient of drillability of rock and $k_i$ is the coefficient of the bit rotary speed. During this cycle a predictable value of the drilling speed V(N) for the next cycle of the mode is determined using said pre-set values of the bit load (bit weight) and the bit rotary speed, which corresponds, in the formula, to a set of coefficients corresponding to $x_i$ and $x_j$.

Subsequently, the measured current value of V and the determined predicted value V(N) of the speed for one and the same cycle N are compared, wherein $\alpha = \ln V(N) - \ln V$. Based on the comparison results corrected values of respective coefficients $k_i$ and $k_j$ of the adaptive model being corrected are formed in accordance with the following formulae:

$$k_i(N) = k_i(N-1) + \mathrm{sign}[\ln V(N) - \ln V]\frac{\alpha \ln x_i}{\sum_{i=1}^{l}(\ln x_i)^2 + \sum_{i=1}^{m} x_j^2};$$

$$k_j(N) = \exp\left\{\ln k_j(N-1) + \mathrm{sign}[\ln V(N) - \ln V]\frac{\alpha x_j}{\sum_{i=1}^{l}(\ln x_i)^2 + \sum_{j=1}^{m} x_j^2};\right\},$$

wherein V is the measured value of mechanical drilling speed during the current cycle.

All coefficients being corrected are corrected simultaneously during each cycle.

Subsequently, taking into account all corrected coefficients and using any appropriate known method, the values of control signals close to optimum values are determined which constitute settings for acting on the bit during the subsequent cycle of said trial mode, the levels of the load on the bit and of its rotary speed during the cycle being kept unchanged.

During each next cycle the above-described sequence of operations of the cycle is repeated, and in determining control signals use is made of the corrected coefficients of the adaptive model of the preceding cycle, and the values of the controlled signals being determined approximate upon the transition to each next cycle those which are optimum ones for given drilling conditions.

A change in the drilling speed from one cycle to another is evaluated and, if the measured drilling speed is equal to the drilling speed computed in two consecutive cycles of the trial mode, a signal for switching over from said trial mode to the drilling mode proper is formed, the control signals formed during the last cycle being used as the control signals for the first cycle of the drilling mode proper. Discretely-varying computed control signals varying in a fixed stepwise manner, which are obtained on the basis of the pre-set quality criterion and which are constant in level during one cycle, are used for subsequent cycles of the drilling mode proper. Drilling speed is measured in each cycle. Using the measured value of the drilling speed, corrected values of coefficient and predicted value of the drilling speed during the cycle are computed. For correcting the coefficients of the adaptive model, use is made of the values of the coefficients being corrected obtained during the preceding cycle. In case the controlled parameters of the drilling process deviate from the desired values, said drilling mode proper is changed over to said formation trial mode and the value of coefficients being corrected obtained during the last cycle of said drilling mode are used for correcting the coefficients.

Therefore, the idea of the method for controlling the process is that, to find out the values of parameters being corrected, a single drilling run is performed using pre-set values of settings for control actions—load on the bit and bit rotary speed.

The efficiency of the method according to the invention may be illustrated by reference to a time-dependent diagram (FIG. 1) where a complex parameter—the product of the load on the bit by its rotary speed (P.n) is plotted on the ordinates to characterize the drilling performance and the drilling time is plotted on the abscissae (the cycle corresponding to the beginning of the trial is shown). With the prior art method of retrieval (curve 1) (the five-point method) the system effects an abrupt change in the combination (P.n) at fixed time intervals in accordance with an a pre-selected sequence of change in the settings, so that generally this combination does not approximate the optimum value in any of the six trial cycles. FIG. 1 shows a case where the trial mode has led to an optimum result by virtue of a mere accident, but the prior art control system cannot "sense" it and it will continue to run in accordance with the pre-set program of change in settings so as to lead the performance away into a non-optimum zone. Since each trial cycle should be long enough (about ten minutes) to obtain reliable results, the total duration of operation of a drilling rig under non-optimum conditions is rather long.

In accordance with the invention, the main retrieval time involves the combination of parameters which is close to an optimum (first cycles are most efficient) (curve 2) so that the drilling performance is substantially greater for sufficiently long trial time (it should be kept in mind that the trial may be repeated many times during the run). In accordance with the invention, no preliminary determination of boundaries of rocks being drilled is required, and identification of parameters is effected while maintaining rational drilling conditions. This provides for an improvement of an average drilling speed and footage per one bit by about 1.75%.

Figure 3:
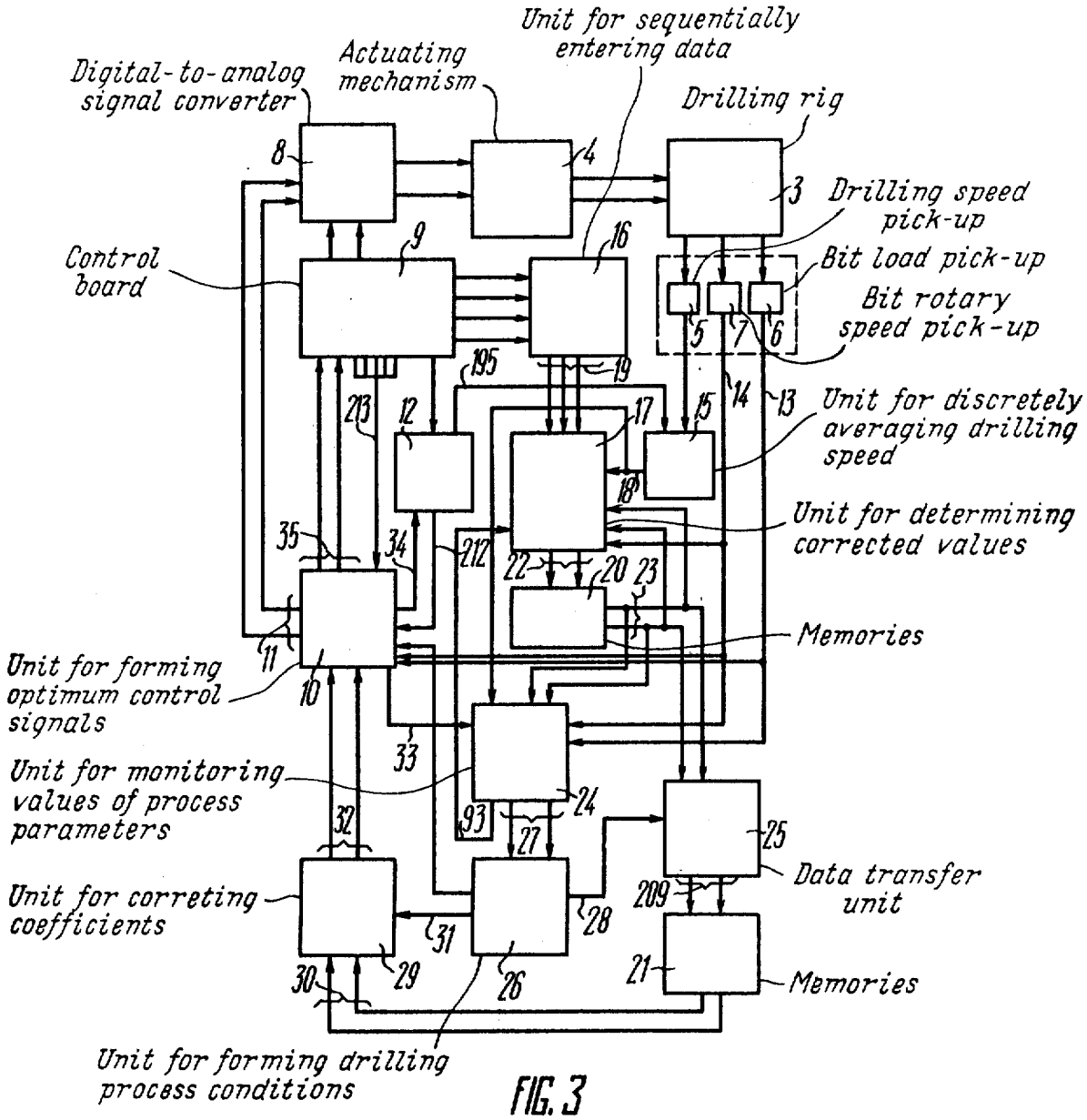
FIG. 3 is a schematic circuit diagram of an apparatus for controlling a drilling rig, according to the invention.

The method according to the invention is carried out by means of an apparatus for controlling the drilling process, the functional diagram of which is given in FIG. 3. The functional diagram shows a drilling rig 3 having respective actuating mechanisms 4, such as an electric drive for causing rotation of the bit and an electric drive of a winch for applying a desired load to the bit, which are well known in the art and are not disclosed in detail herein.

The apparatus has a drilling speed pick-up 5, a bit load pick-up 6 and a bit rotary speed pick-up 7 which are all interconnected with a an electronic computer storing an adaptive model. Inputs of the actuating mechanisms 4 are coupled, via a digital-to-analog signal converter 8, to a control board 9.

The electronic computer comprises a forming unit 10 for forming optimum control signals having outputs 11 which are coupled to inputs of the digital-to-analog converter 8 and outputs coupled to the timer 12 and to inputs 13 and 14 of the pick-ups 6 and 7. According to the invention, the control apparatus also has an averaging unit 15 for discretely averaging drilling speed having inputs which are coupled to the pick-up 5 and to the timer 12. The electronic computer has an entering unit 16 for sequentially entering data from the control board 9; a determining unit 17 for determining corrected values of coefficients of the adaptive model having inputs coupled to an output 18 of the averaging unit 15 and to outputs 19 of the entering unit 16; and two memories 20 and 21. The first memory 20 has its inputs coupled to outputs 22 of the determining unit 17 and its outputs 23 coupled to inputs of the same determining unit 17 and to inputs of a monitoring unit 24 for monitoring values of process parameters. The second memory 21 has its inputs coupled to respective outputs 23 of the memory 20 via a data transfer unit 25.

The electronic computer also has a forming unit 26 for forming drilling process conditions having inputs coupled to an output 27 of the monitoring unit 24 and an output 28 coupled to the input of the data transfer unit 25; and a correcting unit 29 for correcting coefficients of the adaptive model having inputs coupled to outputs 30 of the memory 21 and to an output 31 of the forming unit 26 and outputs 32 coupled to respective inputs of the unit 10 for forming optimum control signals, which has its outputs 33, 34 and 35 coupled also to the input of the monitoring unit 24, to the timer 12 and to the control board 9, respectively.

Figure 4:
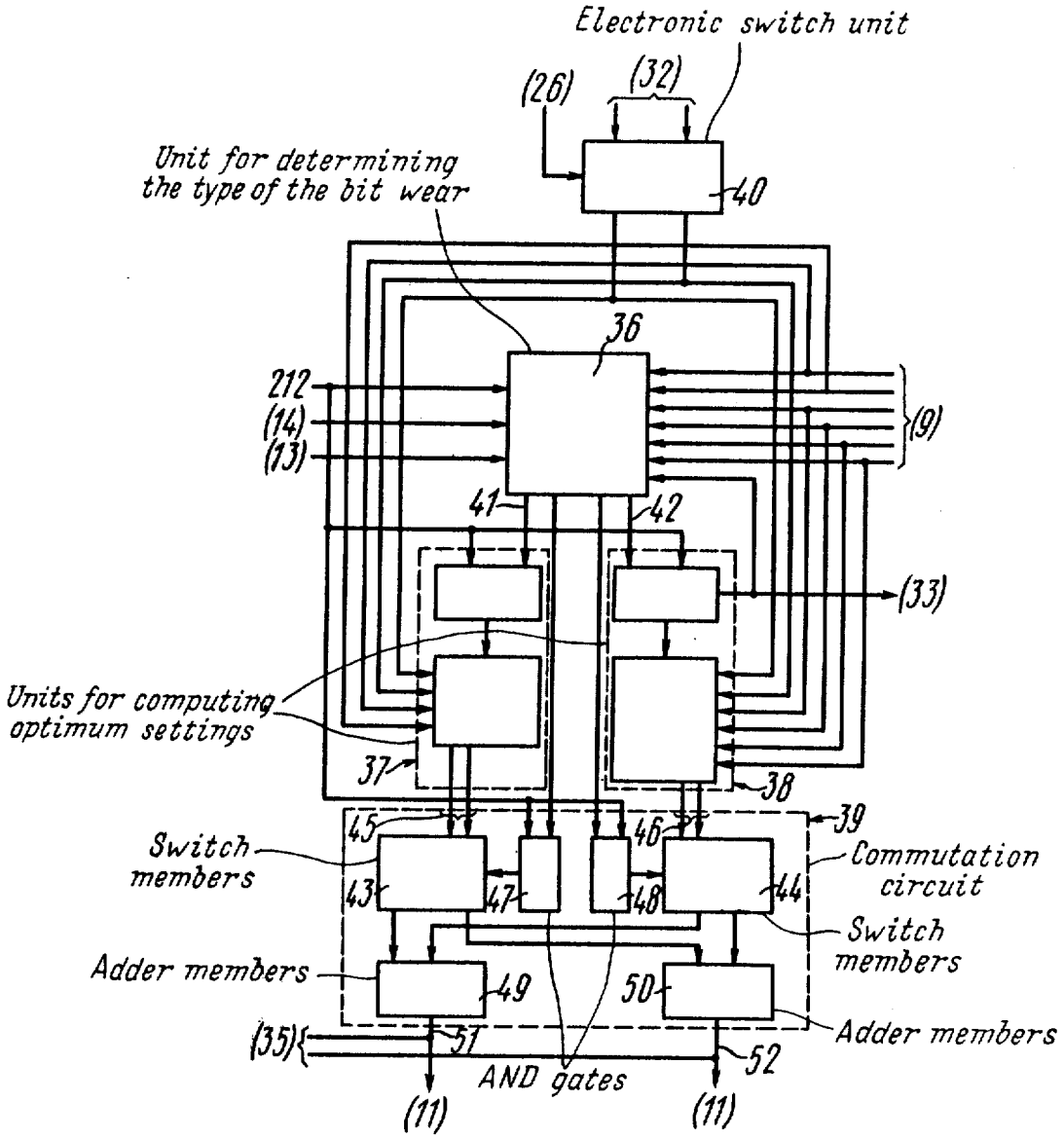
FIG. 4 is a schematic circuit diagram of the unit for forming optimum control signals, according to the invention.

FIG. 4 shows a schematic diagram of the unit 10 for forming optimum control signals, which comprises a type determining unit 36 for determining the type of the bit wear, a computing unit 37 for computing optimum settings in case the bit wear consists in the wear of its seat (bearings), a computing unit 38 for computing optimum settings in case the bit wear consists in the wear of its inserts (teeth), and a commutation circuit 39. The type determining unit 36 has a first group of inputs which are coupled to the output of the timer 12 and to the outputs 13 and 14 of the pick-ups 6 and 7 sensing bit load and bit rotary speed, and a second group of inputs coupled to the control board 9 (FIG. 3).

Inputs of the computing unit 37 (FIG. 4) are coupled to an output 41 of the unit 36 for determining the type of wear, to the timer 12 and to the control board 9, and inputs of the unit 38 are coupled to an output 42 of the unit 36 for determining the type of the bit wear and to the control board 9 (FIG. 3). The units 37 and 38 (FIG. 4) have a group of inputs which are coupled, via an electronic switch unit 40, to the outputs 32 (FIG. 3) of the correcting unit 29 and to the output of the monitoring unit 26.

The commutation circuit 39 (FIG. 4) comprises two groups of switch members 43 and 44, each coupled to outputs 45 and 46 of the units 37 and 38, respectively; AND gates 47 and 48 having their outputs coupled to both groups 43 and 44 of switch members and inputs coupled to outputs of the type determining unit 36 and to the timer 12; and two adder members 49 and 50 having their inputs coupled to outputs of both groups 43 and 44, respectively. Outputs 51 and 52 of the adder members 49 and 50, respectively, are the outputs of the forming unit 10 at which control signals are formed for controlling the actuating mechanisms 4 (FIG. 3) of the drilling rig 3.

The unit 24 for monitoring comprises a functional circuit 53 for raising to power (FIG. 5), three signal multiplying circuits 54, 55 and 56, a signal dividing circuit 57, a comparator 58 and an adder 59. Inputs of the circuit 53 for raising to power are connected to the output 14 (FIG. 3) of the bit rotary speed pick-up 7 and to the output 23 of the memory 20. Inputs of the multiplying circuit 54 (FIG. 5) are coupled to the output 13 (FIG. 3) of the bit load pick-up 6 and to the respective output 23 of the memory 20. An output 60 (FIG. 5) of the circuit 54 is coupled to the input of the multiplying circuit 55 which has its other input coupled to an output 61 of the circuit 53 for raising to power.

Inputs of the signal dividing circuit 57 are coupled to an output 62 of the multiplying circuit and to an output 63 of the adder 59, which has input resistors 64 and 65 and resistor 66 in the feedback circuit and having one input which is coupled, via a variable resistor 67, to a course of shift voltage 68 and another input which is coupled to an output 69 of the multiplying circuit 56. Inputs of the multiplying circuit 56 are coupled to the output 33 (FIG. 3) of the unit 10 for forming optimum control signals and, via a variable resistor 70 (FIG. 5), to a voltage source 71.

Figure 5:
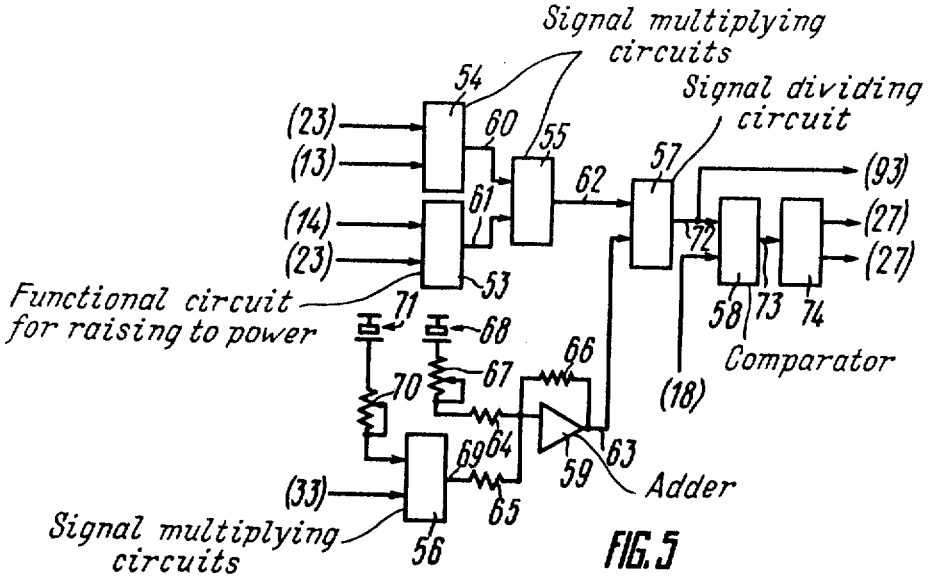
FIG. 5 is a schematic circuit diagram of the unit for monitoring values of parameters according to the invention.

An output 72 of the dividing circuit 57 is coupled to a respective input of the unit 17 (FIG. 3) for determining corrected values of coefficients and to an input of the comparator 58 (FIG. 5). The comparator 58 has its other input coupled to the output 18 (FIG. 3) of the unit 15 for discretely averaging drilling speed and an output 73 which is coupled, via a switching circuit 74, to a respective input of the unit 26 (FIG. 3) for forming drilling process conditions.

Figure 6:
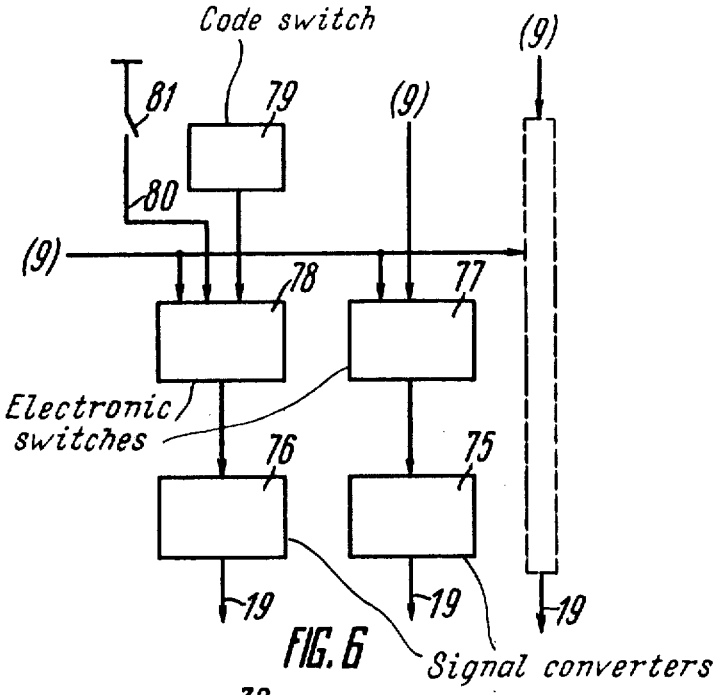
FIG. 6 is a schematic circuit diagram of the unit for sequentially entering data from the control board, according to the invention.

The unit 16 for sequentially entering data from the control board 9 comprises code-to-analog signal converters 75 and 76 (FIG. 6) having their inputs coupled to outputs of electronic switches united into two groups 77 and 78. The input of each electronic switch is coupled to a respective code switch 79 of the control board 9 (FIG. 3) and a control input 80 of each electronic switch (FIG. 6) is coupled to a respective switch 81. For the sake of clarity, the connection is shown for one electronic switch only, but it should be kept in mind that each electronic switch of the groups 77 and 78 is coupled to the control board in the same manner.

Figure 7:
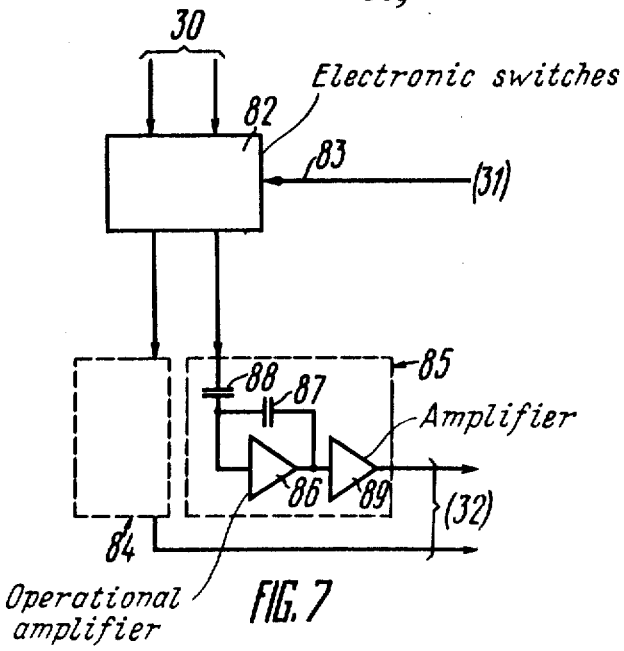
FIG. 7 is a schematic circuit diagram of the unit for correcting coefficients of an adaptive model, according to the invention.

The unit 29 (FIG. 3) for correcting coefficients of the adaptive model comprises a group 82 of electronic switches (FIG. 7) having a common control input 83 and a correcting value former having two channels 84 and 85, each comprising signal memorizing and tracing circuits. Outputs of the channels 84 and 85 are the outputs 32 of the whole correcting unit 29 and their inputs are coupled to the electronic switches.

Each of the channels 84 and 85 comprises a series circuit including an operational amplifier 86 having a capacitor 87 in the feedback circuit and a capacitor 88 at the input, and an amplifier 89 at the output.

According to the invention, the unit 17 (FIG. 3) for determining corrected values of coefficients of the adaptive model comprises a circuit 90 (FIG. 8) for correcting the coefficients corresponding to the drillability of rock which has an output 91 to which is coupled a circuit 92 for correcting the coefficient corresponding to the bit rotary speed. Inputs of the circuits 90 and 92 are coupled to the outputs 19 (FIGs. 3 and 6) of the unit 16 for sequentially entering data, to the outputs 23 of the memory 20, to the output 18 of the unit 15 for discretely averaging drilling speed, to the output 14 of the pick-up 7 and to the output 93 (FIG. 8) of the unit 24 for monitoring parameters of the process.

Outputs of the circuits 90 and 92 are the outputs 22 of the whole unit 17.

Figure 9:
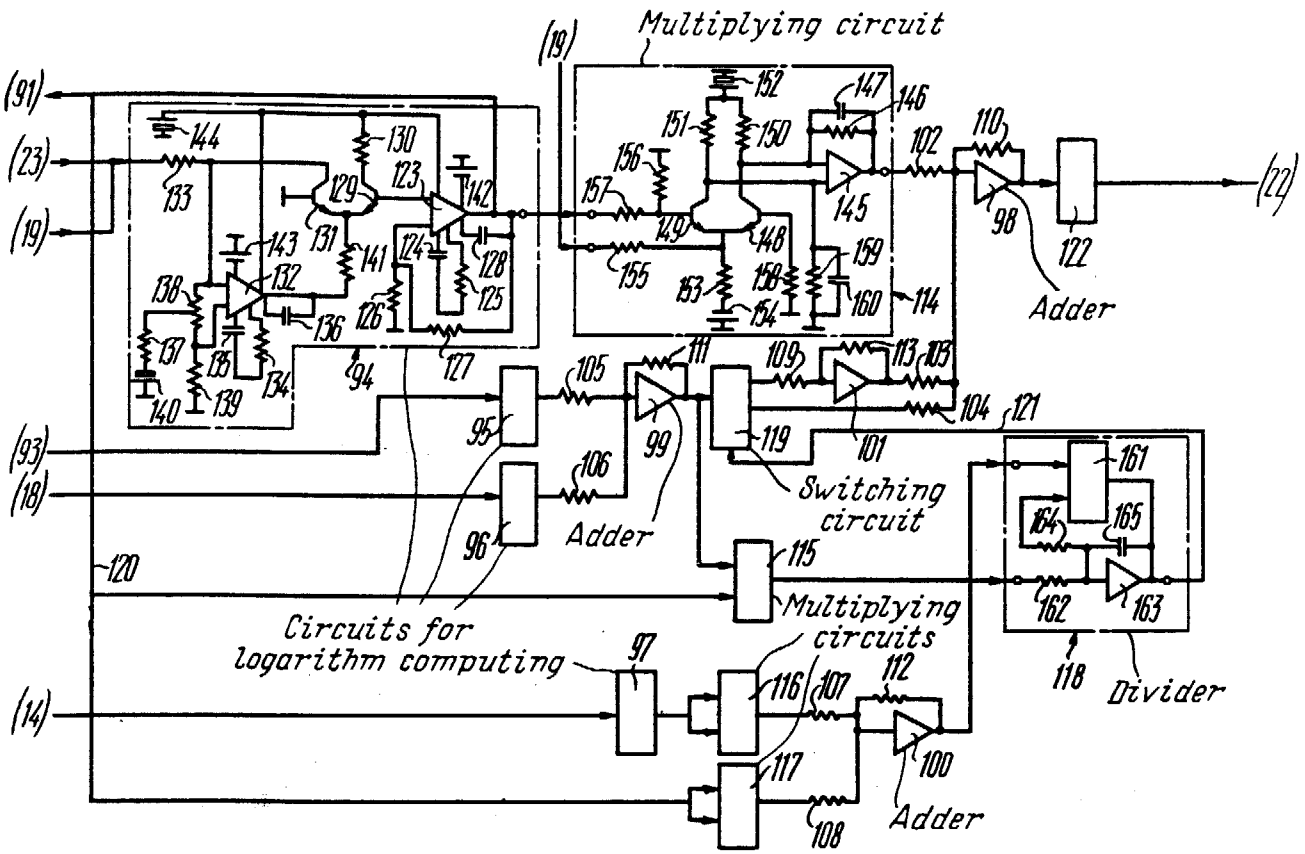
FIG. 9 is a schematic diagram of a circuit for correcting a coefficient corresponding to the drillability of rock, according to the invention.

FIG. 9 shows the circuit 90 for correcting the coefficient corresponding to the drillability of rock. The circuit 90 comprises four identical logarithm-computing circuits 94, 95, 96 and 97; and, the circuit 94 is coupled to the output 23 of the memory 20 (FIGS. 9, 3), the circuit 95 is coupled to an output 93 of the monitoring unit 26, the circuit 96 is coupled to the output 18 of the discrete averaging unit 15 and the unit 97 is coupled to the output 14 of the pick-up 7.

The circuit 90 comprises adders 98, 99 and 100 and an inverter 101 having input resistors 102, 103 and 104, 105 and 106, 107 and 108 and 109, respectively, as well as resistors 110, 111, 112 and 113 in the feedback circuit of operational amplifiers around which are built the units 98 through 101.

In addition, the circuit 90 has identical multiplying circuits 114, 115, 116 and 117, a divider 118 and an electronic switching circuit 119.

The logarithm-computing circuit 94 is coupled to the input of the multiplying circuit 114 which is coupled to the input of the adder 98. The logarithm-computing circuits 95 and 96 are coupled to the inputs of the adder 99 which is coupled, via the electronic switching circuit 119, to the inverter 101. The logarithm-computing circuit 97 is coupled, via the multiplying circuit 116, to one input of the adder 100, which has another input to which is coupled the multiplying circuit 117 having its input coupled to an output 120 of the circuit 94.

To the input of the divider 118 are coupled: directly the output of the adder 100—directly and, via the circuit 115,—the output 120 of the logarithm-computing circuit 94 and the output of the adder 99. An output 121 of the divider 118 is coupled to the input of the electronic switching circuit 119 the outputs of the circuit 119 are coupled directly and via the inverter 101 to the two inputs of the adder 98.

To the output of the adder 98 is coupled an antilogarithm-computing circuit 122 having an output which is the output 22 of the unit 17 for determining corrected values of coefficients.

All circuits 94 through 97, 114 through 117, the circuit 122 and the divider 118 are of a well known type. Thus, FIG. 9 shows the following embodiments of the above-mentioned circuits.

Each of the circuits 94 through 97 comprises, at the input, an operational amplifier 123 having a capacitor 124 and a resistor 125 in the feedback circuit and resistors 126 and 127 and a capacitor 128 in the correcting feedback circuit. A positive supply voltage is fed to the input of the amplifieer 123 through a transistor 129 and a resistor 130. The transistor 129 has its emitter coupled to the emitter of a transistor 131 which has its collector coupled directly to the input of an amplifier 132 and, via a resistor 133, to the output 23 (FIG. 3) of the memory 20. An operational amplifier 132 (FIG. 9) comprises a resistor 134 and capacitors 135 and 136 in the correcting feedback circuits, the inputs of the amplifier 132 are coupled, via voltage dividers 137, 138 and 139 to a negative voltage source 140.

The output of the operational amplifier 132 is coupled, via a resistor 141, to the emitters of the transistors 129 and 131. The circuit 94 comprises negative voltage sources 142 and 143 and a positive voltage 144 source.

Each of the circuits 114 through 117 comprises an operational amplifier 145 having an RC-circuit 146 and 147 in the feedback circuit and transistors 148 and 149 having their collectors oupled, via resistors 150 and 151, to a positive voltage source 152, and which are directly coupled to the inputs of the operational amplifier 145. The emitters of the transistors 148 and 149 are connected to one another and are coupled, via a resistor 153, to a supply source 154 and, via a resistor 155, to the output 19 of the entering unit 16 (FIG. 3). The base of the transistor 149 (FIG. 9) is grounded via a resistor 156 and is coupled to the input of the circuit 114 via a resistor 157. The base of the transistor 148 is grounded via a resistor 158 a filter consisting of a resistor 159 and a capacitor 160 is connected to the input of the operational amplifier 145.

The divider 118 comprises a multiplying circuit 161 having one input which the input of the divider 118. Another input of the divider 118 is coupled, via a resistor 162, to the input of an operational amplifier 163, and, via a resistor 164, to the second input of the circuit 161. The output of the operational amplifier 163 having a capacitor 165 in the feedback circuit is coupled to the output of the circuit 161 and is the output of the divider 118.

Figure 8:
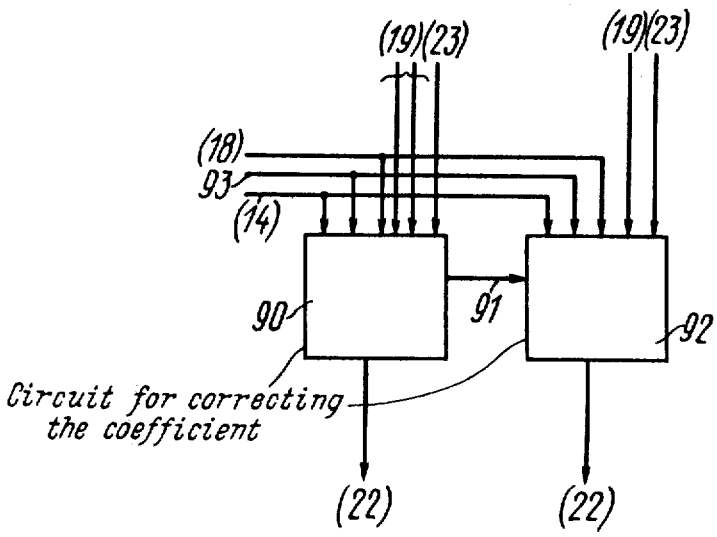
FIG. 8 is a schematic circuit diagram of the unit for determining corrected values of coefficients of an adaptive model, according to the invention.
Figure 10:
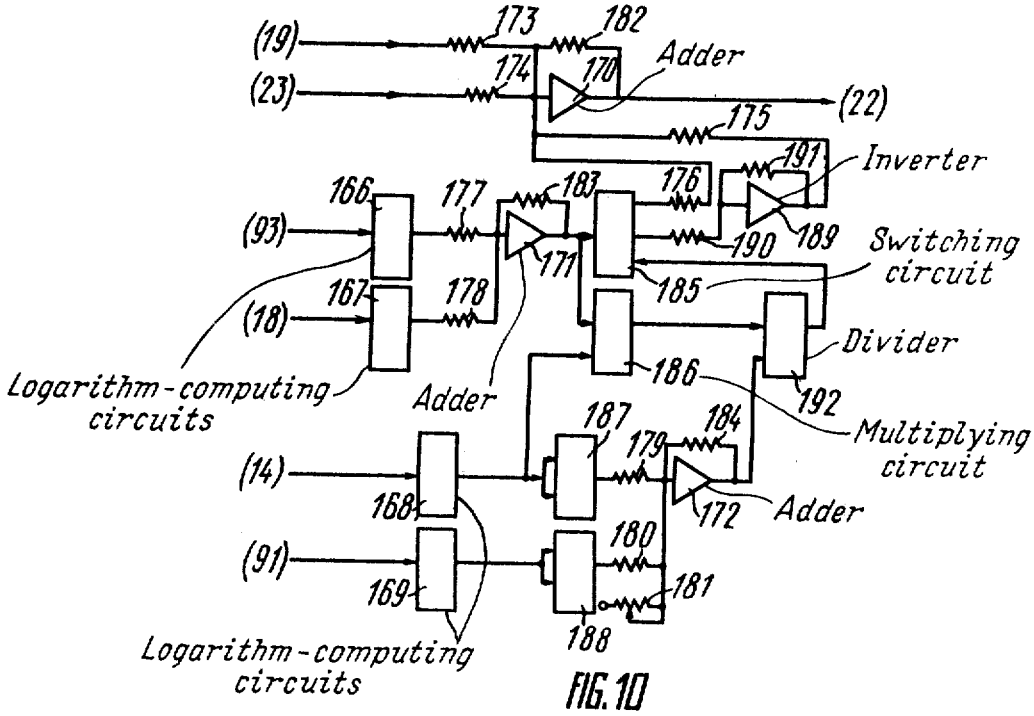
FIG. 10 is a schematic diagram of a circuit for correcting a coefficient corresponding to the rotary speed of a bit, according to the invention.

FIG. 10 shows the circuit 92 for correcting the coefficient corresponding to the rotary speed of the bit. The circuit comprises four identical logarithm-computing circuits 166, 167, 168 and 169; the input of the circuit 166 is coupled to the output 93 of the monitoring unit 24 (FIG. 3), the input of the circuit 167 is coupled (FIGS. 10 and 3) to the output 18 of the averaging unit 15, the input of the circuit 168 is coupled to the output 14 of the pick-up 7 and the input of the circuit 169 is coupled to the output 91 of the correcting circuit 90 (FIG. 8).

The circuit 92 has adders 170, 171 and 172 built around operational amplifiers having input resistors 173, 174, 175 and 176, 177 and 178 and 179, 180 and 181, respectively, and resistors 182, 183 and 184 in the feedback circuit of the operational amplifiers. In addition, the circuit 92 has an electronic switching circuit 185, identical multiplying circuits 186, 187 and 188, an inverter 189 built around an operational amplifier having an input resistor 190 and a resistor 191 in the feedback circuit, and a divider 192.

The logarithm-computing circuits 166 and 167 are coupled to inputs of the adder 171 which has its output coupled to the electronic switching circuit 185. The logarithm-computing circuits 168 and 169 are each coupled, via a respective multiplying circuit 187 and 188, to the two inputs of the adder 172 having its third input connected to a bias voltage fed via a resistor 181, and the output of the adder is coupled to the input of the divider 192. To the other input of the divider 192 is coupled the output of the multiplying circuit 186 having its inputs coupled to the output of the adder 171 and to the output of the logarithm-computing circuit 168.

The output of the divider 192 is coupled to one input of the electronic switching circuit 185, another input of the circuit 185 being coupled the output of the adder 171, and the circuit 185 is coupled directly and via the inverter 189 to two inputs of the adder 170, respectively. Two other inputs of the adder 170 are coupled to the output 19 of the unit 16 (FIGS. 10 and 3) for sequentially entering data and to the output 23 of the memory 20, and the output of the adder 170 is the output 22 of the unit 17 for determining corrected values of coefficients.

Figure 11:
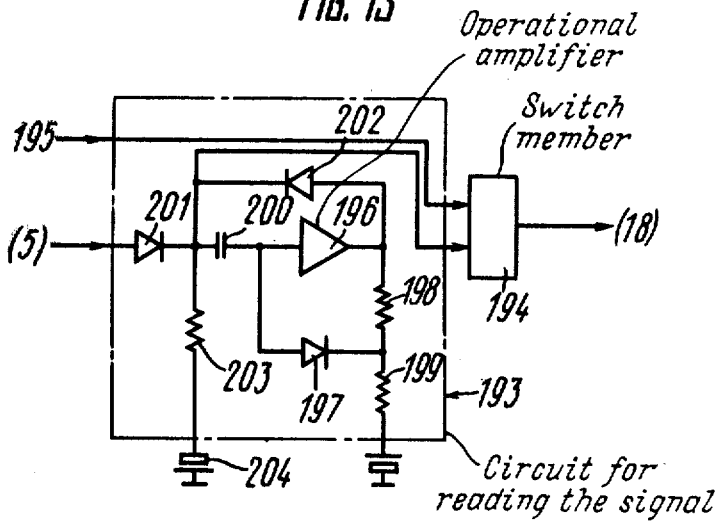
FIG. 11 is a schematic circuit diagram of the unit for discretely averaging drilling speed, according to the invention.

FIG. 11 shows the unit 15 for discretely averaging drilling speed, having a circuit 193 for comparing and reading the signal corresponding to the drilling speed, by reference to the signal envelope and the electronic switch member 194 at the output, the electronic switch member 194 having a control input which is coupled to an output 195 of the timer 12 (FIG. 3).

The circuit 193 comprises an operational amplifier (FIG. 11) having a series circuit including a diode 197 and a resistor 198, and the junction point of the diode and resistor is coupled to a bias voltage source via a resistor 199. The input of the operational amplifier 196 is coupled to a capacitor 200 having the other lead coupled, via a diode 201, to the output of the drilling speed pick-up 5 and, via a diode 202, to the output of the operational amplifier 196 and, via a resistor 203, to a supply source 204.

Figure 12:
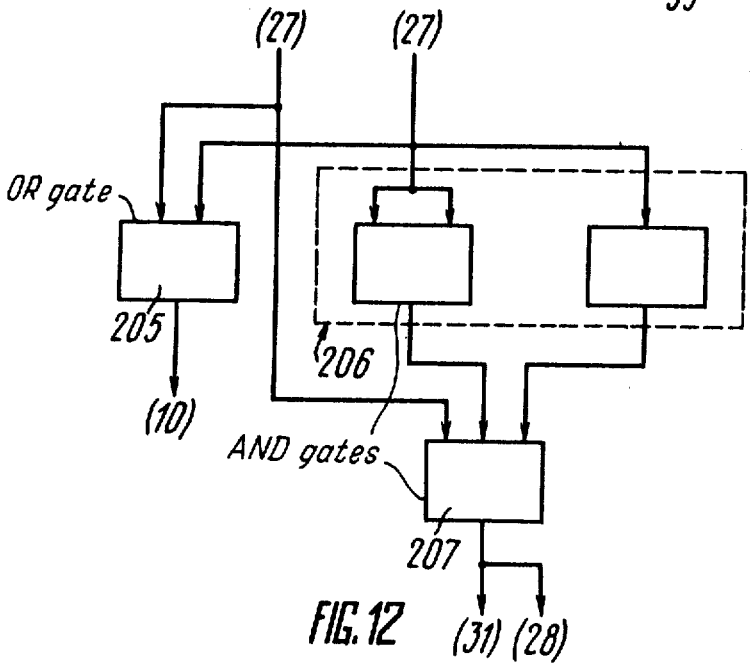
FIG. 12 is a schematic circuit diagram of the unit for forming parameters of the drilling process, according to the invention.

The unit 26 (FIG. 3) for forming drilling process conditions has an OR gate 205 (FIG. 12) and two AND gates 206 and 207. The inputs of the gates 205 and 206 and one input of the gate 207 are coupled to the outputs 27 of the monitoring unit 24. The output of the gate 206 is coupled to the second input of the gate 207, the outputs of the gate 207 being coupled to inputs of the correcting unit 29 and the data transfer unit 25 (FIG. 3) and being the outputs 31 and 28, respectively, of the unit 26 for forming drilling conditions.

Figure 13:
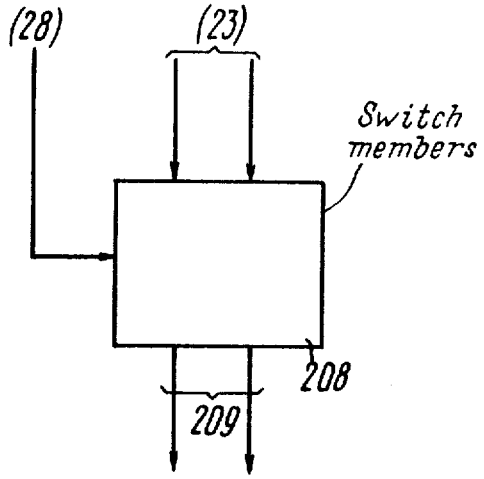
FIG. 13 is a schematic circuit diagram of the data transfer unit, according to the invention.

FIG. 13 diagrammatically shows the data transfer unit 25 which is made in the form of a set of electronic switch members 208 enabling outputs 209 whereby the signals allowing writing of the corrected coefficients of the adaptive model in the memory 21 are fed to the by the command from the unit 26.

Figure 14:
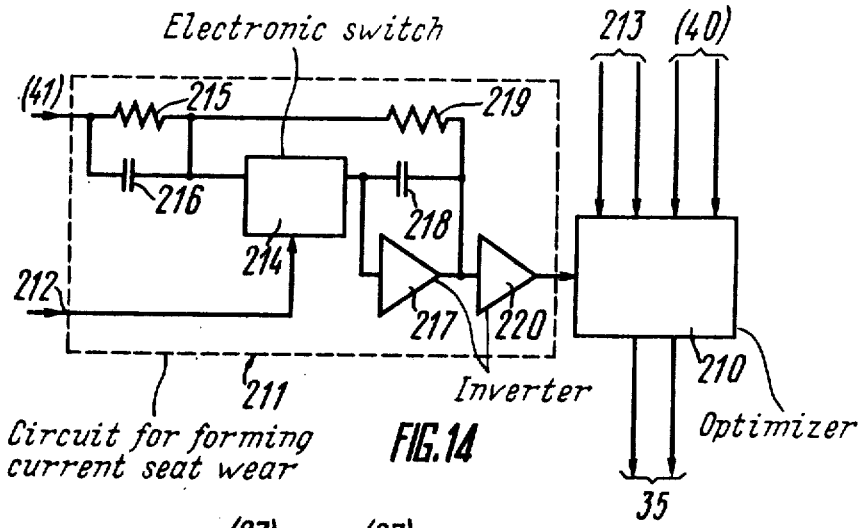
FIG. 14 is a schematic circuit diagram of the unit for computing optimum settings in case the bit wear consists in the bit seat wear, according to the invention.

The unit 37 (FIG. 4) for computing optimum settings in case the bit wear consists in the wear of its seat (bearings), as shown in FIG. 14, comprises an optimizer 210 and a circuit 211 for forming current seat wear coupled to one input of the optimizer and having its inputs coupled to an output 212 of the timer 12 (FIG. 3) and to the output 41 of the unit 36 for determining the type of bit wear (FIG. 4). Inputs of the optimizer 210 (FIG. 14) are coupled to outputs 213 (FIG. 3) of the control board 9, and signals corresponding to optimum settings of load on the bit $P_{opt}$ and rotary speed of the bit $n_{opt}$ are formed at the outputs of the optimizer 210 (FIG. 14) which are the outputs 35 of the computing unit 37 (FIG. 4).

The unit 38 (FIG. 4) for computing optimum settings in case the bit wear consists in the wear of its inserts (teeth) is identical in circuitry with the optimizer, similarly to the unit 37, so that it will not be described in detail.

The optimizer 210 (FIG. 14) used in the units 37 and 38 may comprise any type of well known optimizers so that its design will not be described.

The circuit 211 for forming current wear of seat (or inserts) of the bit comprises an electronic switch 214 having its control input coupled to an output 212 of the timer 12 and the other input coupled to the output 41 of the unit 36 via an RC-circuit 215 and 216. The output of the electronic switch 214 is coupled to an inverter 217 which has a capacitor 218 in its feedback circuit and an output coupled, via a resistor 219, to the second input of the switch 214 and directly coupled to an inverter 220 which is coupled to the input of the optimizer 210.

Figure 15:
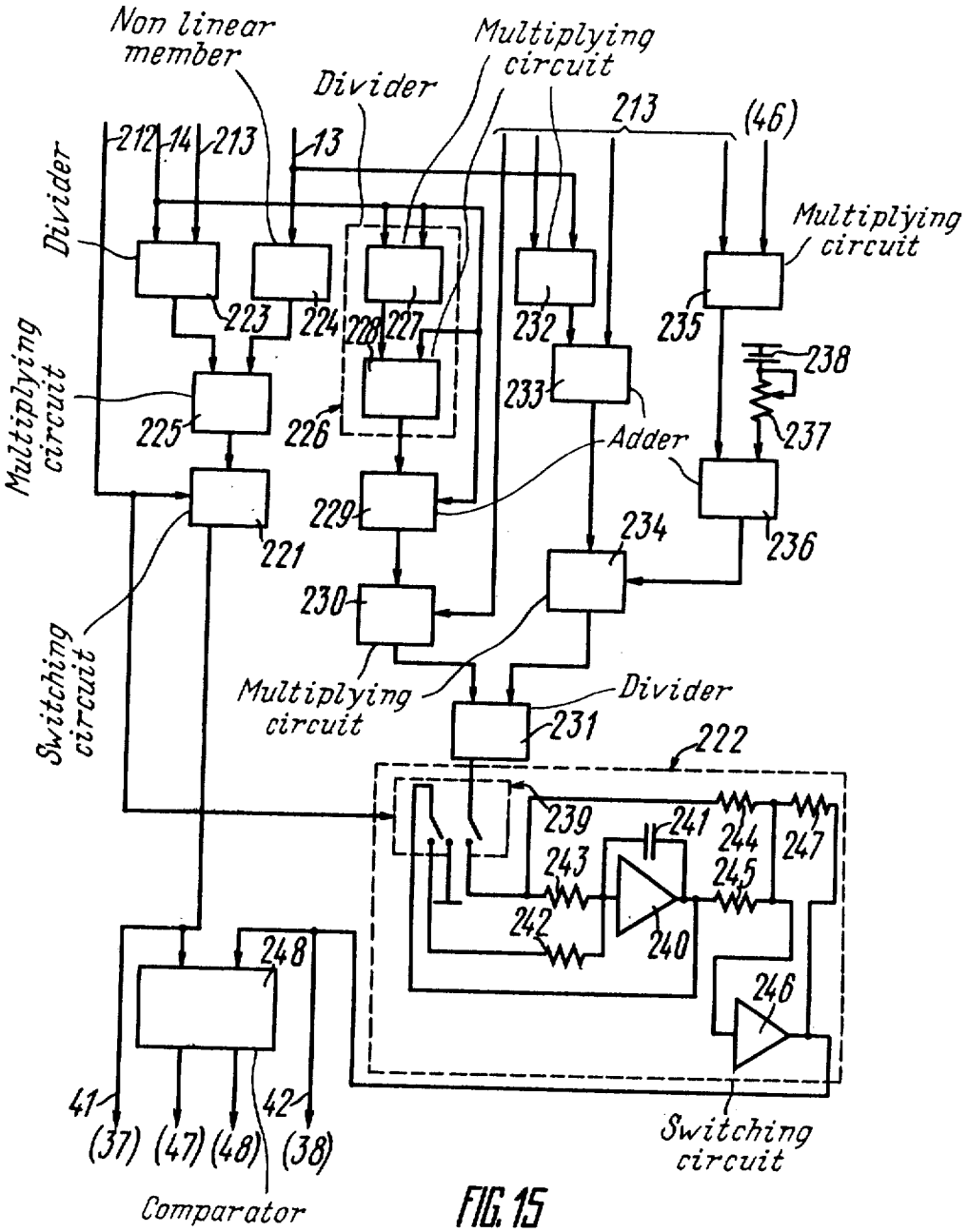
FIG. 15 is a schematic circuit diagram of the unit for determining the type of bit wear, according to the invention.

The unit 36 (FIG. 4) for determining the type of the bit wear, as shown in FIG 15, comprises a two-channel unit wherein each channel is coupled to an input of its own switching circuit 221 or 222, each having another input coupled to the output 212 of the timer 12 (FIG. 3). The first channel comprises a divider 223 coupled to the output 14 (FIGS. 15 and 3) of the pick-up 7 and to the output 213 of the control board 9, a non-linear member 224 having an input coupled to the output 13 of the pick-up 6, and a multiplying circuit 225 having its inputs coupled to the outputs of the divider 223 and non-linear member 224 and its output coupled to the switching circuit 221.

The second channel comprises a divider 226 built around multiplying circuits 227 and 228 and having its input coupled to the output 14 of the pick-up 7, an adder 229 at the output of the divider 226, and a multiplying circuit 230 having its inputs coupled to the output of the adder 229 and its outputs coupled to the input of a divider 231 having its output coupled to the input of the switching circuit 222.

The second channel also comprises a multiplying circuit 232 having its inputs coupled to the output 13 of the pick-up (FIGS. 15 and 3) and to the output 213 of the control board 9.

The output of the circuit 232 is coupled, via an adder 233, to one input of the multiplying circuit 234 having its output coupled to the second input of the divider 231.

Still another multiplying circuit 235 has one computing input coupled to the output 213 of the control board 9, the other input being coupled to the output 46 of the unit 38, and the output of the multiplying circuit 235 is coupled to one input of an adder 36 having another input receiving a bias voltage through a resistor 237 from a source 238, the output of the adder 236 being coupled to the second input of the multiplying circuit 234.

The switching circuits 221 and 222 are identical and each comprises an electronic switch 239 having one output coupled to an operational amplifier 240 having a capacitor 241 in the feedback circuit and a resistor 242 which is connectible by means of the electronic switch 239 to a second feedback circuit of the amplifier 240 a resistor 243 being provided in the forward circuit.

The electronic switch 239 is coupled, via a resistor 244, and the operational amplifier 240 is coupled, via a resistor 245, to an inverter 246 having a resistor 247 in the feedback circuit.

The output of the inverter 246 is the output of the switching circuit 222 (221). The outputs of the switching circuits 221 and 222 are coupled to a comparator 248 having an output signal switching circuit.

The apparatus for controlling the drilling rig functions in the following manner.

The following preparatory operations are performed before starting the apparatus. Signals corresponding to the levels of approximately pre-set values of coefficients being corrected are fed from the control board 9 through the unit 16 for sequentially entering data to the unit 17 for determining corrected values of parameters and to the unit 10 for forming optimum settings of control signals are fed signals corresponding to the values of constant parameters used for optimizing the drilling process.

During the first, starting cycle of the formation trial mode signals of settings for the bit load and bit rotary speed are fed from the control board 9 through the digital-to-analog converters 8 to respective actuating mechanisms 4 which enable the maintenance of the pre-set values of load on the tools and rotary speed of the tool during the drilling cycle, and the timer 12 is started. A signal corresponding to an instant value of drilling speed is fed from the pick-up 5 to the unit 15 for discretely averaging drilling speed. The unit 15 performs averaging of the value of drilling speed for a time interval set by the timer 12. After this pre-set time interval enable signal is fed by the timer 12 through the circuit 195 to the unit 15, a signal corresponding to the level of the averaged value of drilling speed during the first cycle of the trial mode appears at the output 18 of the unit 15 and goes to the determining unit 17 and to the unit 24 for monitoring values of parameters. Coefficients of the adaptive model are corrected in the unit 17 for determining corrected values of parameters upon reception of the signal from the output 18 of the unit 15. Signals from the output 14 of the bit rotary speed pick-up 7 and from the outputs 19 of the unit 16 for sequentially entering data and from the output 93 of the unit 24 for monitoring values of the process parameters are also used for correcting coefficients.

Correction of coefficients occurs simultaneously in two channels 90 and 91.

After the correction the signals corresponding to corrected signals of coefficients of the first cycle are fed from the outputs 22 to the memory 20 and appear at the output 23. The signals from the output 23 are fed to the unit 24 for monitoring values of the process parameters and to the data transfer unit 25.

Signals of the drilling speed from the output 14 of the pick-up 7, signals from the output 13 of the pick-up 6 of the bit load, signals from the output 18 of the unit 15 for averaging the drilling speed and also signals from the output 23 of the memory 20 and from the output 33 of the unit 10 for forming control signals are fed to the monitoring unit 24. A computed drilling speed is determined in the unit 24, which is compared to the averaged value of the speed received from the output 18 of the averaging unit 15. Based on the comparison results signals are formed at the outputs 27 of the unit 24 (at one output in case the signals are equal, and at the other output in case they are different), and these signals are then fed to the unit 26 for forming drilling process conditions. (The signal is fed from one of the outputs 27). In this mode, the signal at the output 27 which is coupled to the OR gate 205 or to the AND gate 206 generates at the output of the OR gate 205 the level of enable signal for the correcting unit 29 at the output 31 and for the data transfer unit 25 at the output 28. At the same time, a signal appears at the output of the gate 205 coupled to the unit 10 for forming optimum control signals.

Upon a signal from the output 28 of the unit 26 for forming drilling process conditions that comes to the enabling input of the electronic switches 208, signals corresponding to corrected values of coefficients are loaded into the second memory 21 and appear at its outputs 30.

Upon a signal from the output 31 of the unit 26 for forming the drilling process conditions in the unit 29 for correcting coefficients of the adaptive model, which is fed to the control input of the group 82 of the electronic switches, signals of the corrected values of coefficients from the output 30 of the memory unit 21 go to two parallel channels 84 and 85 of the correcting value former. An input signal is reproduced in each channel 84 and 85 at the output of the amplifier 89 when the electronic switch is closed, and, upon opening of the switch, an instant value of the input signal at that moment is memorized at the output of the circuit. Signals from the output 32 of the unit 29 for correcting coefficients are fed to the unit 10 for forming optimum control signals—to the inputs of the electronic switches 40 having at their control inputs the signal from the unit 26 for forming process conditions. Signals passing through the circuit 40 go to the units 37 and 38. Simultaneously, the unit 36 for determining the type of the bit wear also operates and has at the inputs thereof signals from the output 13 of the bit load pick-up 6, from the output 14 of the bit rotary speed pick-up 7, from the output of the timer 12, from the group of the outputs 213 of the control board 9 at which levels of constant parameters of the process are pre-set, and from the output of the unit 38 for computing optimum settings in case the bit wear consists in the wear of its seat. The unit 36 forms a signal of the type of bit wear which appears at the output 41 and which is fed to the AND gate 47 in case the signal of the tool wear at the seat (bearings) determined in the unit 36 appears before the signal of the inserts (teeth) wear, and, if otherwise, the signal appears at the output 42 and is fed to the AND gate 48.

Signals corresponding to the levels of current values of the wear of the seat (bearings) and inserts (teeth) of the bit during the cycle of the drilling process, which are fed to their own optimizers 210 for the bit wear at the seat and at the inserts, respectively, are formed in the units 37 and 38. Signals of optimum values of $n_{opt}$ and $P_{opt}$ obtained as a result of optimization of control signals, taking into account the bit wear at the seat (bearings) and the bit wear at the inserts (teeth), appear at the outputs of the optimizers 210, to be fed to respective groups 43 and 44 of the electronic switches. Enable signal from the respective outputs of the gates 47 and 48 is fed to the control inputs of the switches. A signal of the type of the bit wear is fed to the inputs of the gates 47 and 48 and, upon a signal fed from the output of the timer 12, a signal appears at one of the gates 47 or 48 to enable the transfer of optimum control signals from the channel 43 or 44. Optimum values of $n_{opt}$ and $P_{opt}$ are fed, via the outputs 51 and 52, from the output 11, via the digital-to-analog converters 8, to the actuating mechanisms 4.

The transfer of levels of control signals from the unit 10 is effected upon a signal from the timer 12.

The drilling process for the combination of control signals n and P in the first cycle of the trial mode compared to their optimum combination is shown by line $P_1'n_1'$ in FIG. 1.

Figure 2:
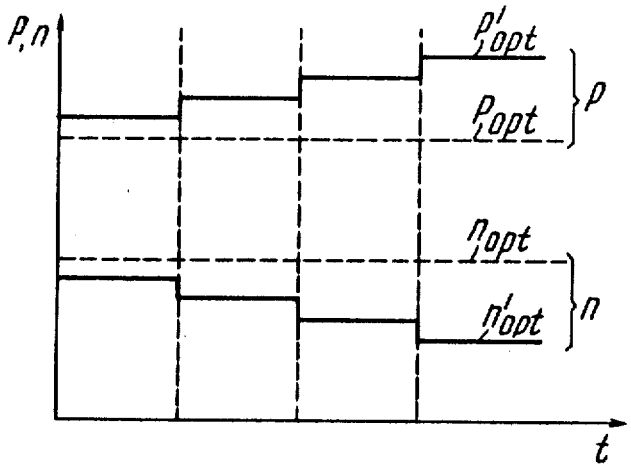
FIG. 2 is a graph showing variation of controlled parameters of the drilling mode in time.

After control signals are fed to the actuating mechanisms 4, a second cycle of the trial mode begins which is represented by line $P_2'n_2'$ in FIG. 2. The actuating mechanisms 4 maintain during this cycle the levels of control signals of the bit rotary speed $n_2'$ and bit load $P_2'$ set by the unit 10. The signal of the mechanical drilling speed fed from the pick-up 5 is averaged and appears at the output 18 of the averaging unit 15 upon a signal from the timer 12. Signals of levels of corrected coefficients of the preceding cycle are fed to the unit 17 for determining corrected values of coefficients through the outputs 23 of the memory 20. Simultaneously, a signal of computed value of mechanical drilling speed is formed in the monitoring unit 24 upon signals from the outputs 14 and 13 of the pick-ups 7 and 6 and is fed through the output 93 to the determining unit 17. The values of coefficients are averaged in the unit 17, and the sequence of interaction of elements in operation of the unit is the same as in the first cycle.

Signals from the determining unit 17 are loaded into the memory 20 and are fed from its output 23 to the monitoring unit 24. Similarly to the first cycle, the values of computed and current mechanical speeds of drilling are compared in the unit 24. Upon a signal from the output 27 the process conditions of the apparatus are formed in the forming unit 26.

In case drilling speed values are different in two consecutive cycles, signals are formed at the outputs of the gates 205 and 207 which are fed to the outputs 31 and 28 of the forming unit 26, and the trial mode continues.

The correcting and forming units 29 and 10 form new levels of control signals, and the interaction of elements in the units 29 and 10 occurs in the same manner as during the first trial cycle.

Upon a signal at the output 212 of the timer 12 the formed control signals are fed through the digital-to-analog converter 8 to the actuating mechanisms 4, and a third cycle of the trial mode is started which is represented by a combination $P_3'n_3'$ in FIG. 1.

During the following cycles of the trial mode represented by combinations $P_4'n_4'$, $P_6'n_6'$ the apparatus functions in the same manner as during the second trial cycle. If the deviation of the mechanical drilling speed in two consecutive cycles does not exceed the tolerance, the counter 208 removes the enable signal from the AND gate 207, no signals appear at the outputs 31 and 28, and the apparatus is switched over to the drilling mode proper.

It should be noted that the forming unit 26 removes the signal from the outputs 31 and 28 during the cycle $P_6'n_6'$. In this mode signals at the outputs 32 of the correcting unit 29 do not change, and the unit 10 for forming optimum control signals at the outputs 11 and 35 provides, upon a signal at the output 212 of the timer 12, for their change during the drilling mode proper (FIG. 2). During each cycle of the drilling mode the averaging unit 15 performs averaging of drilling speed, and the signal of this speed is put, upon a signal from the timer 12, from the output 18 to the unit 17 for correcting the values of coefficients. The unit 17 provides for correcting the values of coefficients, and their new values are loaded into the memory 20 and are simultaneously fed to the unit 24 for monitoring values of parameters. A signal is formed in the unit 24 disabling the feeding of signals from the forming unit 26 at the outputs 31 and 28. This is ensured due to the fact that in a binary two-bit counter circuit the levels of the memorized and incoming signals are compared and, in case they coincide, a signal disabling the feeding of signal by the gate 207 is formed so that the apparatus continues to function in the drilling mode. A signal to the circuit for setting optimum control signals (discretely-varying settings in the drilling mode) which are fed from the unit 10 for forming optimum control signals is fed from the output 212 of the timer 12.

In case the value of the mechanical drilling speed differs by more than the tolerance from the current value of the drilling speed signal, the disabling signal is removed, and the corrected values of coefficients from the memory 21 are transferred to the unit 29 for correcting coefficients and further to the unit 10 for forming optimum control signals. Subsequently the apparatus is switched over back to the trial mode.

The unit 15 for discretely averaging drilling speed functions in the following manner. A signal is fed from the output of the mechanical drilling speed pick-up 5 to the input of the circuit 193 in which comparison and reading of the signal from its envelope occur. This is accomplished continuously in the operational amplifier 196. The input signal is memorized, via the diode 201, at the capacitor 200, and at the same time the signal is compared to the stored value through the diode 202 by means of the amplifier 196. A change in the signal is effected at the moment when partial maximums of the varying input signal from the pick-up 5 are achieved. The signal of the averaged drilling speed appears at the output of the averaging unit 15 upon a control signal from the output 195 of the timer 12.

The unit 17 for determining corrected values of coefficients functions simultaneously in two channels (circuits 90 and 92). The circuit 90 provides for correction of the coefficient corresponding to the drillability of rock.

A signal corresponding to an approximate value of the coefficient to be corrected pre-set from the control board 9 is fed to the input of the circuit 94 in the determining unit 17 from the output 19 during the first cycle of the trial mode. The signal of the coefficient to be corrected is fed during the subsequent cycles to the same input 94 of the unit 17 from the output 23 of the memory 20. The circuit 94 comprises a logarithmic amplifier which is built around two operational amplifiers 123 and 132 and a pair of bipolar matched n-p-n-type transistors 129 and 131. The transistors 129 and 131 operate with different collector current values. The difference of base-emitter voltage is proportional to the logarithm of the ratio of collector currents of the transistors 131 and 129. The collector current of the transistor 131 is the input current of the inverter amplifier 132 so that the collector current is proportional to the ratio of the input signal of the value of the coefficient being corrected to the value of the resistor 133. The collector current of the transistor 129 is proportional to the ratio of the voltage of the source 144 to the value of the resistor 130 since the potential of the non-inverting input of the amplifier 123 is close to zero. The base-emitter difference of potentials is directly applied to the input of the amplifier 123 which functions as a non-inverting amplifier with high gain equal to unity plus the ratio of values of the resistors 127 and 126 and is proportional to the logarithm of the product of the ratio of the input signal to the value of the resistor 133 by the ratio of the value of the resistor 130 to the voltage of the supply sources 144. Therefore, the signal of the value of the coefficient being corrected after passing through the circuit 94 appears at the output in the form of a signal which is proportional to the product of the gain of the operational amplifier 123 by the base-emitter difference of potentials.

The signal from the output of the circuit 94 goes to the circuit 114 in which it is multiplied by the signal fed from the output 19 of the unit 16 for sequentially entering parameters. Upon a signal corresponding to the value of the coefficient being corrected, the internal resistance of the transistor of the bipolar pair of transistors 148 and 149 changes in the circuit 114. The current from the source 154 is re-distributed among the collectors of the pair of transistors, and a difference signal appears between the collectors which is proportional to the gain multiplied by the signal of the value of the coefficient being corrected. The signal fed to the second input of the circuit 114 is fed to the emitters of the transistors 148 and 149 so that the level of current flowing through the resistors 150 and 151 changes. The gain of the circuit 114 is proportional to a constant coefficient multiplied by the ratio of the signal fed to the second input of the circuit 114 to the value of the resistor 155. The signal at the output of the circuit 114 is proportional to the product of the incoming signals multiplied by a constant coefficient.

The signal from the output of the circuit 114 is fed to the adder amplifier 98, the other inputs of the amplifier receiving the signal of a respective polarity from the circuit 119. The desired polarity of the input signal of the amplifier 98 is formed by the circuit 119 which provides for the switching over of the connected coupling and by the inverter 101. The signal to the control input of the circuit 119 is fed from the output of the adding amplifier 99 having inputs which received, after preliminary conversion in the respective logarithm-computing circuits 96 and 95, the signal of averaged value of the drilling speed from the output 18 of the averaging unit 15 and the signal of the computed value of the drilling speed from the output 93 of the monitoring unit 24.

The signal from the output of the divider 118 is fed to the main input of the circuit 119, wherein the dividend is the signal fed to the input of the operational amplifier 163 via the resistor 162 from the output of the multiplying circuit 115, and the divisor is the signal fed to the input of the multiplying circuit 161 from the output of the adder 100. The signal at the output of the adder 100 appears when the signal from the output 14 of the pick-up 7 of the bit rotary speed converted in the circuits 97 and 116 is fed to its inputs. To the other input of the adder 100 is fed the signal from the output of the circuit 94, after the conversion in the multiplying circuit 117.

The signal of the corrected value of the drillability coefficient appears at the output 22 of the antilogarithm-computing circuit 122 upon the appearance of a signal at the output of the adder 98. This signal is the output signal of the circuit 90 for correcting the coefficient of drillability of rock. Similarly to the events occurring in the circuit 90, in the circuit 92 for correcting the coefficient of the bit rotary speed a signal of the value of the coefficient being corrected pre-set from the control board 9 is fed during the first cycle of the trial mode from the output 19 to the adder 170. The signal of the value of the coefficient being corrected is fed during the subsequent cycles from the output 23 of the memory 20 to the input of the adder 170 (input resistor 174). Concurrently with the signal of the coefficient of drillability being corrected, a correcting value from the circuit 185 is fed to one input (input resistor 176) directly and to the other input (input resistor 175) via the inverter 189.

To the control input of the electronic switch 185 are fed a signal from the output of the adder 171 having at the input thereof a signal proportional to the averaged value of drilling speed from the output 18 of the averaging unit 15 and a signal proportional to the computed value of drilling speed during the cycle from the output 93 of the monitoring unit 24.

To the main input of the switch 185 is fed a signal from the output of the divider 192. The dividend signal is formed at the output of the multiplying circuit 186. A signal, proportional to the difference between the averaged value of mechanical drilling speed and the computed value of the speed from the output of the amplifier 171, and a signal from the output 14 of the pick-up 7 converted in the circuit 168 are fed to the inputs of the circuit 186.

The divisor signal fed to the dividing circuit 192 is a signal from the output of the adder 172 to the inputs of which are fed signals from the output 14 of the pick-up 7 and from the output 91 of the circuit 90 for correcting the coefficient of drillability of rock, converted in the logarithm-computing circuits 168 and 169 and multiplying circuits 187 and 188, respectively.

The unit 24 for monitoring process parameters operates upon feeding from the output 23 of the memory 20 signals proportional to the corrected values of coefficients which go to the multiplying circuit 54 and to the circuit 53 for raising to power. The signal from the output 13 of the bit load pick-up 6 is present at the second input of the circuit 54 and a signal from the output 14 of the bit rotary speed pick-up 7 is fed to the second input of the circuit 53. Signals from the outputs 60 and 61 of the circuits 54 and 53 are converted in the multiplying circuit 55 and a signal from the output 62 of this circuit is fed to the dividing circuit 57 to be used as the dividend. The value of the signal which is the divisor appears at the output 63 of the adder 59 to one input of which is fed a bias voltage from the source 68 and to the other input of which is fed a signal from the multiplying circuit 56 upon multiplication of two signals—one from the supply source 71 (the resistor 70 sets the level of a constant value used) and the other from the output 33 of the unit 10 for forming control signals. The signal proportional to the computed value of drilling speed is fed from the output 72 of the circuit 57 to the comparator 58, and to the second input thereof is fed a signal from the output 18 of the unit 15 for averaging drilling speed. The signal from the comparator 58 is fed to the input of the switching circuit 74 which changes the levels of signals at the outputs 27 in case the computed and averaged values of drilling speed are identical.

The two channels of the unit 36 for determining the type of the bit wear—the channel for determining the bit wear consisting in the seat (bearings) wear and the channel for determining the bit wear consisting in the inserts (teeth) wear—function concurrently. In the channel for determining the bit wear consisting in the seat wear, from the output 213 of the control board 9 is fed a signal of a constant value corresponding to the value of the constant of the bit seat (bearing) and a signal of the bit rotary speed as a divisor is fed concurrently with the constant signal to the divider 223 from the output 14 of the pick-up 7. The converted signal is fed from the divider 223 to the input of the multiplying circuit 225 to the second input of which is fed a signal from the output 13 of the pick-up 6 of the bit load converted in the non-linear member 224.

The product of the two signals is fed from the output of the circuit 225 to the switching circuit 221. The switching circuit 221 is the output circuit of the channel. A signal from the output 212 of the timer 12 is fed to the control input of the circuit 221. In case there is a signal at the output 212, an integration of the input signal fed from the circuit 225 is effected in the circuit 221 (and similarly, in the circuit 222). The integration is effected in an integrator (in the amplifier 240 of the channel for the bit wear). Upon a short-time removal of the signal from the control input of the circuit 221 the signal at the output thereof becomes equal to zero, and the integration of the input signal is repeated in the circuit 221.

At the same time, in the second channel, a signal is received from the output 14 of the pick-up 7 which is proportional to the bit rotary speed and which, after being converted in the circuits 227 and 228, is fed to the adder 229. Addition in the adder 229 is effected with respective gains at the inputs. The signal from the output of the adder 229 is fed to the input of the multiplying circuit 230 with a signal fed from the output 213 of the control board 9. The resulting signal at the output of the circuit 230 is fed to the input of the divider 231 and is used as a dividend. To the second input of the divider 231 is fed a signal from the output of the multiplying circuit 234 which multiplies two signals of which one signal is fed from the output of the adder 233 and the other signal is fed from the output of the adder 236.

The signal appears at the output of the adder 233 upon feeding a signal from the output of the circuit 232 which multiplies two signals—a signal from the output 13 of the load pick-up 6 and a signal from the output 213 of the control board 9 which was added to a signal from another output of the control board 9.

A signal of the second factor or component for the circuit 234 appears upon adding a signal from the resistor 237 which represents a constant value and signals from the output 213 and from the output 33 characterizing the current wear of inserts. A signal from the output of the divider 231 goes through the switching circuit 222 functioning in the same manner as the circuit 221 to the input of the comparator 248 having the switching circuit and a signal proportional to the value of the bit wear consisting in the seat wear is fed to the other input.

A signal at the outputs of the comparator 247 having the switching circuit varies in accordance with the ratio of signals coming to the input of the circuit from the channel for determining the bit wear consisting in the seat (bearings) wear and from the channel for determining the bit wear consisting in the inserts (teeth) wear. The unit 37 (and similarly the unit 38) operates upon feeding to the circuit 211 a signal from the output 41 from the type determining unit 36 which, in case there is enable signal fed from the output 212 of the timer 12, passes through the switch 214 and is accumulated in an integrator built around the inverter. Thus, accumulation of the signal of current wear during the time of operation is effected which is determined by the time during which the circuit is connected through the electronic switch 214. A signal is fed through the inverter 220 to the optimizer 210 to which signals are also fed from the outputs 213 of the control board 9 which correspond to the levels of constant values used in finding out optimum control signals. At the same time, the optimizer 210 receives from the outputs of the unit 40 signals of corrected values of coefficients. Optimum control signals are determined in the optimizer 210 taking into account the fact that the admissible wear of the bit seat occurs during the drilling before admissible wear of the inserts. The optimizer 210 determines optimum control signals taking into account the wear of the bit seat, which are fed to the outputs 35 upon feeding a new value from the output of the unit 37.

Similarly, optimum control signals are formed taking into account the wear of the inserts of the bit. Depending on the signal from the unit 36 for determining the type of the bit wear, optimum control signals are fed to the actuating mechanisms 4 from the outputs of the groups of electronic switch members 43 or 44.

This invention enables an improvement of the productivity of the drilling process, especially in deep well drilling owing to the use of optimum drilling conditions for each rock formation being drilled and also makes it possible to rationally utilize the life of the bit.

We claim:

1. A method for controlling drilling process, using two control modes of which one mode is a mode of trial of a rock formation being drilled and the other mode is a drilling mode proper, said formation trial mode being a multicycle mode, and wherein each cycle of said trial mode comprises the steps of:

pre-setting values of control signals for controlling drilling process;

measuring drilling speed corresponding to said pre-set values of control signals;

pre-setting during the first cycle certain approximate values of coefficients of an adaptive model being corrected;

computing the drilling speed during the cycle of said trial mode using said pre-set values of control signals and said pre-set approximate values of coefficients of the adaptive model being corrected;

comparing said computed drilling speed to said measured drilling speed for one and the same cycle;

forming, based on the results of the comparison, a corrected value of a respective coefficient of the adaptive model being corrected;

determining, taking into account said corrected coefficients, values of control signals closest to optimum values, which are used as settings for acting on the bit during the next cycle of said trial mode;

using corrected coefficients of the adaptive model obtained during the preceding cycle for determining control signals for each next cycle, the values of control signals being determined approximating optimum values for given drilling conditions upon transition to each next cycle; and if the measured drilling speed coincides with the computed drilling speed in two consecutive cycles, forming a signal for changing over from said trial mode to said drilling mode proper, the control signal formed during the last two cycles being the control signal to be used in said drilling mode proper; and if controlled parameters of the process deviate from desired parameters, effecting a change over from said drilling mode proper to said rock formation trial mode.

2. A method according to claim 1, wherein said adaptive model of drilling process is constructed based on the following set of equations:

$$\ln V(N) = \sum_{i=1}^{l} k_i(N)\ln x_i + \sum_{j=1}^{m} x_j \ln k_j(N),$$

wherein N is the number of channels, V(N) is said computed value of drilling speed during Nth cycle; $k_i$ and $k_j$ are said coefficients of the adaptive model being corrected, corresponding to said control signals; $x_i$ and $x_j$ are the values of said control signals; i and j are the numbers of said control signals; said corrected values of respective coefficients being determined from the formulae:

$$k_i(N) = k_i(N-1) + \mathrm{sign}[\ln V(N) - \ln V]\frac{\alpha \ln x_i}{\sum_{i=1}^{l}(\ln x_i)^2 + \sum_{j=1}^{m} x_j^2};$$

$$k_j(N) = \exp\Big\{ \ln k_j(N-1) +$$

-continued $$\left.\operatorname{sign}[\ln V(N) - \ln V)] \frac{\alpha x_j}{\sum_{i=1}^{l} (\ln x_i)^2 + \sum_{j=1}^{m} x_j^2}\ ;\right\}$$

wherein V is said measured value of drilling speed, $\alpha$ is the constant coefficient, the value of which depends on the pre-set admissible difference between said measured value of drilling speed and said computed value of drilling speed.

3. A method according to claim 1, further varying in a stepwise fashion said control signals in said drilling mode proper as the drilling continues; said stepwise variation of said control signals being effected with regularity and the degree of change at which said control signals remain close to optimum control signals, taking into account the wear of the bit bearings and teeth during the drilling.

4. A method according to claim 1, further comprising effecting the correction of coefficients of said adaptive model in said drilling mode proper in accordance with pre-set control signals and values of said drilling speed obtained for specific drilling conditions.

5. A method according to claim 1, further comprising changing over from said drilling mode proper to said trial mode, if said drilling speed in said drilling mode proper deviates substantially, said coefficients of the adaptive model obtained at the moment said drilling mode proper is completed being used upon said change-over as starting values of coefficients being corrected for the first cycle of the trial mode.

6. A method according to claim 1, further comprising using the load on the bit and the rotary speed of the bit as said control signals.

7. A method according to claim 2, further comprising varying in a stepwise fashion said control signals in said drilling mode proper as the drilling continues, said stepwise variation of said control signals being effected with regularity and the degree of change at which said control signals remain close to optimum control signals, taking into account the wear of the bit bearings and teeth during the drilling.

8. A method according to claim 2, further comprising changing over from said drilling mode proper to said trial mode if said drilling speed in said drilling mode proper deviates substantially, said coefficients of the adaptive model obtained at the moment said drilling mode proper is completed being used upon said change-over as starting values of coefficients being corrected for the first cycle of the trial mode.

9. A method according to claim 2, further comprising using the load on the bit and the rotary speed of the bit as said control signals.

10. A method according to claim 5, further comprising using the load on the bit and the rotary speed of the bit as said control signals.

11. A method according to claim 7, further comprising changing over from said drilling mode proper to said trial mode if said drilling speed in said drilling mode proper deviates substantially, said coefficients of the adaptive model obtained at the moment said drilling mode proper is completed being used upon said change-over as starting values of coefficients being corrected for the first cycle of the trial mode.

12. A method according to claim 7, further comprising using the load on the bit and the rotary speed of the bit as said control signals.

13. A method according to claim 11, further comprising using the load on the bit and the rotary speed of the bit as said control signals.

14. An apparatus for controlling drilling process which is performed by means of a drilling rig having actuating mechanisms, the number of the actuating mechanisms corresponding to the number of control signals for controlling drilling process, said apparatus comprising:

a control board for controlling drilling process, having a plurality of inputs and a plurality of outputs;

a digital-to-analog converter coupled to a group of outputs selected from said plurality of outputs of said control board, said converter interconnecting said control board and said actuating mechanisms of the drilling rig;

a drilling speed pick-up having an output;

a bit load pick-up having an output;

a timer having an output and coupled to said control board;

an electronic computer storing an adaptive model of drilling process, said electronic computer determining values of control signals which are closest to optimum values for given drilling conditions as well as signals for change-over from a trial mode to a drilling mode proper, and vice-versa;

a monitoring unit for monitoring values of parameters which has an input and an output, interconnected with said electronic computer and determining a computed value of mechanical drilling speed based on signals of corrected values of coefficients and forming a signal for changing-over for the trial mode or for the drilling mode proper;

an averaging unit for discretely averaging drilling speed having inputs and outputs, said inputs of said averaging unit being coupled to said output of said drilling speed pick-up and to said output of said timer;

said electronic computer having:

an entering unit for sequentially entering data from said control board having inputs and outputs, said inputs of said entering unit being coupled to a group of outputs selected from said plurality of outputs of said control board;

a determining unit for determining corrected values of coefficients of the adaptive model having inputs and outputs, respective inputs of said determining unit being coupled to said output of said averaging unit and to said outputs of said entering unit, said determining unit forming signals of corrected values of coefficients of the adaptive model, wherein upon a signal from said averaging unit and upon a signal of the computed value of drilling speed from said monitoring unit a correcting value is determined for each coefficient being corrected, which corrects the value of the signal of the coefficient being corrected fed in a first starting cycle;

a first memory having inputs and outputs, respective inputs of said first memory being coupled to respective outputs of said determining unit, respective outputs of said first memory being coupled to said inputs of said determining unit and to said input of said monitoring unit;

a data transfer unit having inputs and outputs, said inputs of said second memory being coupled to respective outputs of said data transfer unit for transferring signals of corrected values of coefficients from the output of said first memory to said second memory;

a first forming unit for forming drilling process conditions having inputs and outputs, said inputs of said first forming unit being coupled to said outputs of said monitoring unit, an outputs of said first forming unit being coupled to an input of said data transfer unit for enabling operation thereof, said first forming unit matching operation of the apparatus in each mode by pre-setting respective signals;

a second forming unit for forming optimum control signals having inputs coupled to said output of said timer and to said outputs of said bit load pick-up and of said bit rotary speed pick-up and outputs coupled to said inputs of said digital-to-analog converter, and forming control signals fed to said actuating mechanisms upon signals of corrected values of coefficients based on signals from the bit rotary speed and bit load pick-ups, said signals being produced from said timer in accordance with the drilling conditions determined by a signal from said first forming unit; and, a correcting unit for correcting coefficients of the adaptive model having inputs coupled to said outputs of said first forming unit and to said outputs of said second memory and outputs coupled to respective inputs of said second forming unit.

15. An apparatus according to claim 14, wherein said second forming unit for forming optimum control signals comprises:

a unit for determining the type of the bit wear, having a first group of inputs, a second group of inputs and outputs, said first group of inputs being coupled to said output of said timer and to said outputs of said bit load pick-up and of said bit rotary speed pick-up, said second group of inputs being coupled to said outputs of said control board;

a unit for computing optimum settings if the bit wear consists in the wear of its bearings, having an output and inputs which are coupled to said output of said timer, to said outputs of said control board, to said outputs of said unit for determining the type of the bit wear, to said outputs of said correcting unit for correcting coefficients and to said outputs of said monitoring unit for monitoring parameters, respectively;

a unit for computing optimum settings if the bit wear consists in the wear of its teeth, having outputs and inputs, which are coupled to said outputs of said control board, to said outputs of said unit for determining the type of the bit wear, to said outputs of said correcting unit for correcting coefficients and to said outputs of said monitoring unit for monitoring values of coefficients, respectively;

and a switching circuit comprising: a first group of switch members coupled to said outputs of said unit for computing optimum settings if the bit wear consists in the wear of its bearings; a second group of switch members coupled to said outputs of said unit for computing optimum settings if the bit wear consists in the wear of its teeth; AND gates having inputs coupled to said output of said timer and to said outputs of said unit for determining the type of the bit wear and outputs coupled to one of said groups of switch members; a first adder member having an output and inputs which are coupled to said first and second groups of switch members; a second adder member having an output and inputs which are coupled to said first and second groups of switch members; said outputs of said first and second adder members being the outputs of the second forming unit for forming optimum control signals at which control signals are formed for controlling said actuating mechanisms of the drilling rig.

16. An apparatus according to claim 14, wherein said monitoring unit for monitoring values of parameters comprises:

a functional circuit for raising to power having outputs and inputs which are coupled to said output of said bit rotary speed pick-up and to a respective output of said first memory;

a second signal multiplying circuit having outputs and inputs which are coupled to said output of said first multiplying circuit and to said output of said functional circuit;

a dividing circuit having a first input to which is coupled said output of said second multiplying circuit, a second input and an output which is coupled to said respective input of said determining unit for determining corrected values of coefficients;

an adder having a first input, a second input and an output;

a shift voltage source;

a variable resistor coupled to said shift voltage source and to said first input of said adder;

said output of said adder being coupled to said second input of said dividing circuit;

a third signal multiplying circuit having an input coupled to said respective output of said second forming unit for forming optimum control signals and an output coupled to said second input of said adder;

a comparator having a first input coupled to said output of said dividing circuit, a second input coupled to said output of said averaging unit for discretely averaging drilling speed, and an output;

a switching circuit coupled to said output of said comparator and to said respective input of said first forming unit for forming drilling process conditions.

17. An apparatus according to claim 14, wherein said determining unit for determining corrected values of coefficients of the adaptive model comprises:

a first circuit for correcting the coefficient corresponding to the drillability of rock, having inputs which are coupled to respective outputs of said averaging unit for discretely averaging drilling speed, of said monitoring unit for monitoring values of coefficients, of said entering unit for sequentially entering data and of said first memory for the transfer of signals corresponding to values of coefficients of the adaptive model during the preceding cycle; and a second circuit for correcting the coefficient corresponding to the bit rotary speed, having inputs which are coupled to respective outputs of said averaging unit for discretely averaging drilling speed, of said monitoring unit for monitoring values of parameters, of said entering unit for sequentially entering data and of said first memory for the transfer of signals corresponding to values of coefficients of the adaptive model during the preceding cycle.

18. An apparatus according to claim 14, wherein said averaging unit for discretely averaging drilling speed comprises a circuit for reading the signal corresponding to drilling speed from its envelope having an input and an output; and a switch member having an input coupled to said output of said circuit for reading the signal, a control input coupled to said output of said timer and an output at which is formed a signal enabling the transfer of a signal corresponding to the averaged value of drilling speed.

19. An apparatus according to claim 14, wherein said first forming unit for forming drilling process conditions comprises:

an OR gate having inputs, which are the inputs of the first forming unit for forming conditions and which are coupled to respective outputs of said monitoring unit for monitoring values of parameters, and outputs which are the outputs of said first forming unit;

a first AND gate having inputs coupled to respective outputs of said monitoring unit for monitoring values of parameters and an output; and a second AND gate having a first input coupled to said output of said first AND gate, a second input combined with a respective input of said OR gate and coupled to a respective output of said monitoring unit for monitoring values of parameters, and an output which is the output of said first forming unit.

20. An apparatus according to claim 15, wherein said monitoring unit for monitoring values of parameters of the adaptive model comprises:

a functional circuit for raising to power having outputs and inputs which are coupled to said output of said bit rotary speed pick-up and to a respective output of said first memory;

a first signal multiplying circuit having outputs and inputs which are coupled to said outputs of said bit load pick-up and to a respective output of said first memory;

a second signal multiplying circuit having outputs and inputs which are coupled to said output of said functional circuit;

a dividing circuit having a first input to which is coupled said output of said second multiplying circuit, a second input and an output which is coupled to said respective input of said unit for determining corrected values of coefficients;

an adder having a first input, a second input and an output;

a shift voltage source;

a variable resistor coupled to said shift voltage source and to said first input of said adder;

said output of said adder being coupled to said second input of said dividing circuit;

a third signal multiplying circuit having an input coupled to said respective output of said second forming unit for forming optimum control signals and an output coupled to said second output of said adder;

a comparator having a first input coupled to said output of said dividing circuit, a second input coupled to said output of said averaging unit for discretely averaging drilling speed, and an output;

a switching circuit coupled to said output of said comparator and to said respective input of said first forming unit for forming drilling process conditions.

21. An apparatus according to claim 15, wherein said first forming unit for computing optimum control signals if the bit wear consists in the wear of its bearings comprises an optimizer having inputs and an output which forms signals corresponding to optimum signals of bit load and bit rotary speed in accordance with the current wear of the bit bearing; a circuit for forming current wear of the seat, having inputs which are coupled to said output of the timer and to said output of said type determining unit for determining the type of the bit wear and outputs which are coupled to said inputs of said optimizer.

22. An apparatus according to claim 15, wherein said second computing unit for computing optimum control signals if the bit wear consists in the wear of its teeth comprises an optimizer having inputs and an output which forms signals corresponding to optimum settings of the bit load and bit rotary speed in accordance with current wear of the bit teeth; and a circuit for forming current wear of the bit teeth, having inputs which are coupled to said output of the timer and to said output of said type determining unit for determining the type of the bit wear, and outputs which are coupled to said inputs of said optimizer.

23. An apparatus according to claim 15, wherein said type determining unit for determining the type of bit wear comprises a first switching circuit and a second switching circuit and first and second channels, each channel being coupled to said timer and to a respective switching circuit, said first channel comprising:

a first divider having an output and inputs which are coupled to said output of said bit rotary speed pick-up and to a respective output of said control board;

a non-linear member having an input coupled to said output of said bit load pick-up and an output;

a first multiplying circuit having inputs coupled to said output of said first divider and to said output of said non-linear member and an output coupled to said input of said first switching circuit;

said second channel comprising:

a first multiplying circuit having two inputs coupled to said output of said bit rotary speed pick-up and an output;

a second multiplying circuit having a first input coupled to said output of said first multiplying circuit, a second input coupled to said output of said bit rotary speed pick-up and an output;

a first adder having a first input coupled to said output of said second multiplying circuit, a second input coupled to said output of said bit rotary speed pick-up and an output;

a third multiplying circuit having a first input coupled to a respective output of said control board, a second input coupled to said output of said first adder and an output;

a first divider having a first input coupled to said output of said third multiplying circuit, a second input and an output;

a second adder having a first input coupled to a respective output of said control board, a second input and an output;

a fourth multiplying circuit having a first input coupled to said output of said second adder, a second input and an output coupled to said second input of said first divider;

a fifth multiplying circuit having inputs coupled to said output of said bit load pick-up and to a respective output of said control board, respectively, and an output coupled to said second input of said second adder;

a sixth multiplying circuit having a first input coupled to a respective output of said control board, a second input coupled to said output of said second forming unit for forming optimum control signals and an output;

a third adder having a first input to which is fed a bias voltage, a second input coupled to said output of said sixth multiplying circuit and an output coupled to said second input of said fourth multiplying circuit.

24. An apparatus according to claim 15, wherein said determining unit for determining corrected values of coefficients comprises:

a first circuit for correcting a coefficient corresponding to the drillability of rock, having inputs which are coupled to respective outputs of said averaging unit for discretely averaging drilling speed, of said monitoring unit for monitoring values of parameters, of said entering unit for sequentially entering data and of said first memory for the transfer of signals corresponding to values of coefficients of the adaptive model of the preceding cycle; and a second circuit for correcting the coefficient corresponding to the bit rotary speed, having inputs which are coupled to respective outputs of said averaging unit for discretely averaging drilling speed, of said monitoring unit for monitoring values of parameters, of said entering unit for sequentially entering data and of said first memory for the transfer of signals corresponding to values of coefficients of the adaptive model of the preceding cycle.

25. An apparatus according to claim 17, wherein said circuit for correcting the coefficient corresponding to the drillability of rock comprises:

a first logarithm-computing circuit having an output and an input which is coupled to said output of said first memory;

a second logarithm-computing circuit having an output and an input which is coupled to said output of said monitoring unit for monitoring values of parameters;

a third logarithm-computing circuit having an output and an input which is coupled to said output of said averaging unit for discretely averaging drilling speed;

a fourth logarithm-computing circuit having an output and an input which is coupled to said output of said bit rotary speed pick-up;

first, second, third and fourth multiplying circuits each having a first input, a second input and an output, said first input of said first multiplying circuit being coupled to said output of said first logarithm-computing circuit, said first input of said third multiplying circuit being coupled to said output of said fourth logarithm-computing circuit, said first input of said second logarithm-computing circuit and said first and second inputs of said fourth multiplying circuit being coupled to said output of said first logarithm-computing circuit;

a first adder having a first input coupled to said output of said first multiplying circuit, a second input, a third input and an output;

a second adder having a first input to which is coupled said output of said second logarithm-computing circuit, a second input to which is coupled said output of said third logarithm-computing circuit, and an output;

a switching circuit having an input coupled to said output of said second adder, a second input, a first output coupled to said second input of said first adder and a second output;

an inverter having an input coupled to said second output of said switching circuit and an output coupled to said third input of said first adder;

a third adder having a first input and a second input which are coupled to respective outputs of said third and fourth multiplying circuits, and an output;

a divider having an input coupled to said output of said second logarithm-computing circuit, a second input coupled to said output of said third adder and an output coupled to said second input of said switching circuit;

an antilogarithm-computing circuit having an input coupled to said output of said first adder and an output which is the output of said circuit for correcting the coefficient corresponding to the drillability of rock.

26. An apparatus according to claim 17, wherein the circuit for correcting the coefficient corresponding to the rotary speed comprises:

a first adder having first, second and third inputs and an output, said first input of said first adder being coupled to said output of said first memory, said output of said first adder being the output of said circuit for correcting the coefficient corresponding to the rotary speed;

a first logarithm-computing circuit having an input coupled to said output of said monitoring unit for monitoring values of parameters, and an output;

a second logarithm-computing circuit having an input coupled to said output of said averaging unit for discretely averaging drilling speed and an output;

a third logarithm-computing circuit having an input coupled to said output of said bit rotary speed pick-up and an output;

a fourth logarithm-computing circuit having an input coupled to said output of said first circuit for correcting the coefficient and an output;

a second adder having first and second inputs which are coupled to said outputs of said first and second logarithm-computing circuits, respectively, and an output;

a switching circuit having an input coupled to said output of said second adder, a first output coupled to said second input of said first adder and a second output;

an inverter having an input coupled to said second output of said switching circuit and an output coupled to said third input of said first adder;

first, second and third multiplying circuits each having a first input, a second input and an output, said first input of said first multiplying circuit being coupled to said output of said second adder, said second input of said first multiplying circuit and said first and second inputs of said second multiplying circuits being coupled to said output of said third logarithm-computing circuit, said first and second inputs of said third multiplying circuit being coupled to said output of said fourth logarithm-computing circuit;

a third adder having first and second inputs which are coupled to said outputs of said second and third multiplying circuits and an output;

a divider having a first input coupled to said output of said first multiplying circuit, a second input coupled to said output of said third adder and an output coupled to said input of said switching circuit.

27. An apparatus according to claim 20, wherein said averaging unit for discretely averaging drilling speed comprises:

a circuit for reading a signal corresponding to drilling speed from its envelope having an input and an output;

and a switch member having an input coupled to said output of the circuit for reading the signal, a control input coupled to said output of said timer and an output at which is formed a signal enabling the transfer of a signal corresponding to the averaged value of drilling speed.

28. An apparatus according to claim 20, wherein said determining unit for determining corrected values of coefficients of the adaptive model comprises:

a first circuit for correcting the coefficient corresponding to the drillability of rock, having inputs which are coupled to respective outputs of said averaging unit for discretely averaging drilling speed, of said monitoring unit for monitoring values of parameters, of said entering unit for sequentially entering data and of said first memory for the transfer of signals corresponding to values of coefficients of the adaptive model in the preceding cycle.

29. An apparatus according to claim 20, wherein said first forming unit for forming drilling process conditions comprises:

an OR gate having inputs, which are the inputs of the first forming unit for forming conditions and which are coupled to respective outputs of said monitoring unit for monitoring values of parameters, and outputs which are the outputs of said first forming unit;

a first AND gate having inputs coupled to respective outputs of said monitoring unit for monitoring values of coefficients and an output; and a second AND gate having a first input coupled to said output of said first AND gate, a second input combined with a respective input of said OR gate and coupled to a respective output of said monitoring unit for monitoring values of parameters, and an output which is the output of said first forming unit.

30. An apparatus according to claim 20, wherein said first computing unit for computing optimum settings if the bit wear consists in the wear of its bearings comprises an optimizer having inputs and an output which forms signals corresponding to optimum control signals of the bit load and of the bit rotary speed in accordance with current wear of the bit bearings and a circuit for forming current wear of the seat, having inputs which are coupled to aid output of the timer and to said output of the type determining unit for determining the type of the bit wear and outputs which are coupled to said inputs of said optimizer.

31. An apparatus according to claim 20, wherein said second computing unit for computing optimum control signals if the bit wear consists in the wear of its teeth compromises an optimizer having inputs and an output which forms signals corresponding to optimum control signals of the bit load and bit and bit rotary speed in accordance with current wear of the bit teeth; and a circuit for forming current wear of the bit teeth, having inputs which are coupled to said output of the timer and to said output of said type determining unit for determining the type of the bit wear, and outputs which are coupled to said inputs of said optimizer.

32. An apparatus according to claim 21, wherein said unit for computing optimum control signals if the bit wear consists in the wear of its teeth comprises an optimizer having inputs and an output forming signals corresponding to optimum control signals of the load on the bit and of the rotary speed of the bit in accordance with the current wear of the teeth of the bit; and a circuit for forming current wear of the bit teeth, having inputs which are coupled to said output of the timer and to said output of said type determining unit for determining the type of the bit wear and outputs which are coupled to said inputs of said optimizer.

33. An apparatus according to claim 28, wherein said averaging unit for discretely averaging drilling speed comprises:

a circuit for reading a signal corresponding to drilling speed from the envelope having an input and an output;

and a switch member having an input coupled to said output of said circuit for reading the signals, a control input coupled to said output of said timer and an output at which is formed a signal enabling the transfer of a signal corresponding to the averaged value of drilling speed.

34. An apparatus according to claim 28, wherein said first forming unit for forming drilling process conditions comprises:

an OR gate having inputs, which are the inputs of the first forming unit for forming conditions and which are coupled to outputs of said monitoring unit for monitoring values of parameters, and outputs which are the outputs of said first forming unit;

a first AND gate having inputs coupled to respective outputs of said monitoring unit for monitoring values of parameters and an output; and a second AND gate having a first input coupled to said output of said first AND gate, a second input combined with a respective input of said OR gate and coupled to a respective output of said monitoring unit for monitoring values of parameters, and an output which is the output of said first forming unit.

35. An apparatus according to claim 28, wherein said first computing unit for computing optimum control signals if the bit wear consists in the wear of its bearings comprises an optimizer having inputs and an output and forming signals corresponding to optimum control signals of the load on the bit and of the rotary speed of the bit in accordance with current wear of the bit bearing; and a circuit for forming current wear of the seat, having inputs which are coupled to said output of the timer and to said output of said type determining unit for determining the type of the bit wear and outputs which are coupled to said inputs of said optimizer; and said unit for computing optimum control signals if the bit wear consists in the wear of its teeth comprises an optimizer having inputs and an output and forming signals corresponding to optimum control signals of the load on the bit and of the rotary speed of the bit in accordance with current wear of the bit teeth; and a circuit for forming current wear of the bit teeth, having inputs which are coupled to said output of the timer and to said output of said type determining unit for determining the type of the bit wear, and outputs which are coupled to said inputs of said optimizer.

36. An apparatus according to claim 28, wherein said circuit for correcting the coefficient corresponding to the drillability of rock comprises:

a first logarithm-computing circuit having an output and an input which is coupled to said output of said first memory;

a second logarithm-computing circuit having an output and an input which is coupled to said output of said monitoring unit for monitoring values of coefficients;

a third logarithm-computing circuit having an output and an input which is coupled to said output of said averaging unit for discretely averaging drilling speed;

a fourth logarithm-computing circuit having an output and an input which is coupled to said output of said bit rotary speed pick-up;

first, second, third and fourth multiplying circuits each having a first input, a second input and an output, said first input of said first multiplying circuit being coupled to said output of said first logarithm-computing circuit, said first input of said third multiplying circuit being coupled to said output of said fourth logarithm-computing circuit, said first input of said second logarithm-computing circuit and said first and second inputs of said fourth multiplying circuit being coupled to said output of said first logarithm-computing circuit;

a first adder having a first input coupled to said output of said first multiplying circuit, a second input, a third input and an output;

a second adder having a first input to which is coupled said output of said second logarithm-computing circuit, a second input to which is coupled said output of said third logarithm-computing circuit, and an output;

a switching circuit having an input coupled to said output of said second adder, a second input, a first output coupled to said second input of said first adder and a second output;

an inverter having an input coupled to said second output of said switching circuit and an output coupled to said third input of said first adder;

a third adder having a first input and a second input which are coupled to said respective outputs of said third and fourth multiplying circuits, and an output;

a divider having a first input coupled to said output of said second logarithm-computing circuit, a second input coupled to said output of said third adder and an output coupled to said second input of said switching circuit;

an antilogarithm-computing circuit having an input coupled to said output of said first adder and an output which is the output of said circuit for correcting the coefficient corresponding to the drillability of rock.

37. An apparatus according to claim 28, wherein the circuit for correcting the coefficient corresponding to rotary speed comprises:

a first adder having first, second and third inputs and an output, a first input of said first adder being coupled to said output of said first memory, said output of said first adder being the output of said circuit for correcting the coefficient corresponding to rotary speed;

a first logarithm-computing circuit having an input coupled to said output of said monitoring unit for monitoring values of parameters, and an output;

a second logarithm-computing circuit having an input coupled to said output of said averaging unit for discretely averaging drilling speed and an output;

a third logarithm-computing circuit having an input coupled to said output of said bit rotary speed pick-up and an output;

a fourth logarithm-computing circuit having an input coupled to said output of said first circuit for correcting the coefficient and an output;

a second adder having a first input and a second input which are coupled to said outputs of said first and second logarithm-computing circuits, respectively, and an output;

a switching circuit having an input coupled to said output of said second adder, a first output coupled to said second input of said first adder and a second output;

an inverter having an input coupled to said second output of said switching circuit and an output coupled to said third input of said first adder;

first, second and third multiplying circuits each having a first input, a second input and an output, said first input of said first multiplying circuit being coupled to said output of said second adder, said second input of said first multiplying circuit and said first and second inputs of said second multiplying circuit being coupled to said output of said third logarithm-computing circuit, said first and second inputs of said third multiplying circuit being coupled to said output of said fourth logarithm-computing circuit;

a third adder having a first input and a second input which are couple to said outputs of said second and third multiplying circuits and an output;

a divider having a first input coupled to said output of said first multiplying circuit, a second input coupled to said output of said third adder and an output coupled to said second input of said switching circuit.

38. An apparatus according to claim 32, wherein said averaging unit for discretely averaging drilling speed comprises:

a circuit for reading a signal corresponding to drilling speed from the envelope, having an input and an output;

and a switch member having an input coupled to said output of said circuit for reading the signal, a control input coupled to said output of said timer and an output at which is formed a signal enabling the transfer of a signal corresponding to the averaged value of drilling speed.

39. An apparatus according to claim 35, wherein said averaging unit for discretely averaging drilling speed comprises:

a circuit for reading a signal corresponding to drilling speed from the envelope, having an input and an output;

and a switch member having an input coupled to said output of said circuit for reading the signal, a control input coupled to the output of said timer and an output at which is formed a signal enabling the transfer of a signal corresponding to the averaged value of drilling speed.

40. An apparatus according to claim 35, wherein said first forming unit for forming drilling process conditions comprises:

an OR gate having inputs, which are the inputs of the first forming unit for forming conditions and which are coupled to respective outputs of said monitoring unit for monitoring values of parameters, and outputs which are the outputs of said first forming unit;

a first AND gate having inputs coupled to respective outputs of said monitoring unit for monitoring values of parameters and an output; and a second AND gate having a first input coupled to said output of said first AND gate, a second input combined with a respective input of said OR gate and coupled to a respective output of said monitoring unit for monitoring values of parameters and an output which is the output of said first forming unit.

41. An apparatus according to claim 36, wherein the circuit for correcting the coefficient corresponding to rotary speed comprises:

a first adder having first, second and third inputs and an output, said first input of said first adder being coupled to said output of said first memory, said output of said first adder being the output of said circuit for correcting the coefficient corresponding to rotary speed;

a first logarithm-computing circuit having an input coupled to said output of said monitoring unit for monitoring values of parameters and an output;

a second logarithm-computing circuit having an input coupled to said output of said averaging unit for discretely averaging drilling speed and an output;

a third logarithm-computing circuit having an input coupled to said output of said bit rotary speed pick-up and an output;

a fourth logarithm-computing circuit having an input coupled to said output of said first circuit for correcting the coefficient and an output;

a second adder having first and second inputs which are coupled to said outputs of said first and second logarithm-computing circuits, respectively, and an output;

a switching circuit having an input coupled to said output of said second adder, a first output coupled to said second input of said first adder and a second output;

an inverter having an input coupled to said second output of said switching circuit and an output coupled to said third input of said first adder;

first, second and third multiplying circuits each having a first input, a second input and an output, said first input of said first multiplying circuit being coupled to said output of said second adder, said second input of said first multiplying circuit and said first and second inputs of said second multiplying circuit being coupled to said output of said third logarithm-computing circuit, said first and second inputs of said third multiplying circuit being coupled to said output of said forth logarithm-computing circuit;

a third adder having a first input and a second input which are coupled to said outputs of said second and third multiplying circuits and an output;

a divider having a first input coupled to said output of said first multiplying circuit, a second input coupled to said output of said third adder and an output coupled to said second input of said switching circuit.

42. An apparatus according to claim 40, wherein said first forming unit for forming drilling process conditions comprises:

an OR gate having inputs, which are the inputs of the first forming unit for forming conditions and which are coupled to respective outputs of said monitoring unit for monitoring values of parameters, and outputs which are the outputs of said first forming unit;

a first AND gate having inputs coupled to respective outputs of said monitoring unit for monitoring values of parameters and an output; and a second AND gate having a first input coupled to said output of said first AND gate, a second input combined with a respective input of said OR gate and coupled to a respective output of said monitoring unit for monitoring values of parameters and an output which is the output of said first forming unit.

43. An apparatus according to claim 42, wherein said control board comprises a plurality of code switches and a plurality of switches and said entering unit for sequentially entering data comprises a group of electronic switches in a number ensuring the entering of a desired volume of data from said control board, each electronic switch of said group having an input coupled to a respective code switch from said plurality of code switches and a control input coupled to a respective switch from said plurality of switches, and code-to-analog signal converters, the number of the converters corresponding to the number of electronic switches in said group, each converter being coupled to a respective electronic switch.

44. An apparatus for controlling drilling process performed by means of a drilling rig having actuating mechanisms, the number of mechanisms corresponding to the number of controlled parameters of the drilling process, the apparatus comprising:

a control board for controlling drilling process having a plurality of inputs and a plurality of outputs;

a digital-to-analog converter coupled to a group of outputs selected from said plurality of outputs of said control board and interconnecting said control board and said actuating mechanisms of the drilling rig;

a drilling speed pick-up having an output;

a bit load pick-up having an output;

a bit rotary speed pick-up having an output;

a timer having an output and coupled to said control board;

an electronic computer storing an adaptive model of drilling process, said computer determining values of control signals for given drilling conditions which are close to optimum values and also signals for transition from a trial mode to a drilling mode proper, and vice versa;

a monitoring unit for monitoring values of parameters of the adaptive model having an input and an output which is coupled to said electronic computer, and comprising: a functional circuit for raising to power having outputs, a first input and a second input which is coupled to said output of said bit rotary speed pick-up; a first signal multiplying circuit having outputs, a first input and a second input which is coupled to said outputs of said bit load pick-up; a second signal multiplying circuit having outputs and inputs coupled to said output of said first multiplying circuit and to said output of said functional circuit; a dividing circuit having a first input to which is coupled said output of said second multiplying circuit, a second input and an output; an adder having a first input, a second input and an output; a shift voltage source; a variable resistor coupled to said shift voltage source and coupled to said first input of said adder; said output of said adder being coupled to said second input of said dividing circuit; a third signal multiplying circuit having an input and an output which is coupled to said second input of said adder; a comparator having a first input coupled to said output of said dividing circuit, a second input and an output; a switching circuit having a first input coupled to said output of said comparator, a second input and an output; said first inputs of said functional circuit and first multiplying circuit, said second inputs of said dividing circuit, comparator and switching circuit being the inputs of said monitoring unit and said outputs of said dividing circuit and of said switching circuit being the outputs thereof;

an averaging unit for discretely averaging drilling speed having inputs and an output, said inputs of said averaging unit being coupled to said output of said drilling speed pick-up and to said output of said timer, and said averaging unit comprising: a circuit for reading a signal corresponding to drilling speed from the envelope thereof, having an input which is the input of the averaging unit and an output; and a switch member having an input coupled to said output of said circuit for reading the signal, a control input coupled to said output of said timer and an output at which is formed a signal corresponding to the averaged drilling speed;

said electronic computer comprising:

an entering unit for sequentially entering data from said control board having inputs and outputs, said inputs of said entering unit being coupled to a group of outputs selected from said plurality of outputs of said control board;

a determining unit for determining corrected values of coefficients of the adaptive model having a first circuit for correcting the coefficient corresponding to the drillability of rock, having inputs which are coupled to respective outputs of said averaging unit for discretely averaging drilling speed, of said monitoring unit for monitoring values of parameters and of said entering unit for sequentially entering data and which transfers signals corresponding to values of coefficients of the adaptive model in the preceding cycle; a second circuit for correcting the coefficient corresponding to bit rotary speed, having inputs which are coupled to respective outputs of said averaging unit for discretely averaging drilling speed, of said monitoring unit for monitoring values of parameters and of said entering unit for sequentially entering data and which transfers signals corresponding to values of coefficients of the adaptive model in the preceding cycle; said unit for determining corrected values having outputs which are the outputs of said first and second correcting circuits;

a first memory having inputs and outputs, said respective inputs of said first memory being coupled to respective outputs of said determining unit, respective outputs of said first memory being coupled to said inputs of said first and second circuits for correcting coefficients and to said input of said monitoring unit;

a data transfer unit having inputs and outputs, said inputs of said data transfer unit being coupled to respective outputs of said first memory;

a second memory having inputs and outputs, said inputs of said second memory being coupled to respective outputs of said data transfer unit, a first forming unit for forming drilling process conditions comprising:

an OR gate having inputs, which are the inputs of the first forming unit for forming conditions and which are coupled to respective outputs of said monitoring unit for monitoring values of parameters, and outputs which are the outputs of the first forming unit and which are coupled to said inputs of said data transfer unit, a first AND gate having inputs coupled to respective outputs of said monitoring unit for monitoring values of parameters and an output; a second AND gate having a first input coupled to said output of said first AND gate, a second input combined with a respective input of said OR gate and coupled to a respective output of said monitoring unit for monitoring values of parameters and an output which is the output of the first forming unit for forming conditions and which is coupled to a respective input of said data transfer unit;

a second forming unit for forming optimum control signals comprising: a unit for determining the type of the bit wear having a first group of inputs, a second group of inputs and outputs, said first group of inputs being coupled to said output of said timer and to said outputs of said bit load pick-up and of said bit rotary speed pickup, said second group of inputs being coupled to said outputs of said control board; a unit for computing optimum control signals if the bit wear consists in the wear of its bearings, having outputs and inputs which are coupled to said output of said timer, to said outputs of said control board, to said outputs of said unit for determining the type of the bit wear and to said outputs of said monitoring unit for monitoring values of parameters, respectively; a unit for computing optimum control signals if the bit wear consists in the wear of its teeth, having outputs and inputs which are coupled to said outputs of said control board, to said outputs of said unit for determining the type of the bit wear and to said outputs of the monitoring unit for monitoring values of parameters, respectively; and a commutation circuit having inputs coupled to said outputs of said units for computing optimum settings and outputs which are the outputs of the second forming unit for forming optimum control signals at which are formed control signals for controlling said actuating mechanisms of the drilling rig; and a correcting unit for correcting coefficients of the adaptive model having inputs coupled to said outputs of said first forming unit and to said outputs of said second memory and outputs coupled to respective inputs of said units for computing optimum settings in case the bit wear consists in the wear of its bearing and teeth.

45. An apparatus according to claim 44, wherein said commutation circuit comprises: a first group of switch members; a second group of switch members; an AND gate having inputs coupled to said output of said timer and to said outputs of said unit for determining the type of the bit wear and outputs coupled to said first and second groups of switch members; a first adder having an output and inputs which are coupled to said first and second groups of switch members; a second adder having an output and inputs coupled to said first and second groups of switch members; said outputs of said first and second adder members being the outputs of said commutation circuit.

46. An apparatus according to claim 44, wherein said unit for determining the type of the bit wear has a first switching circuit and a second switching circuit and a first channel and a second channel, each channel being coupled to said timer and to a respective switching circuit, said first channel comprising:

a first divider having an output and inputs which are coupled to said output of said bit rotary speed pick-up and to a respective output of said control board;

a non-linear member having an input coupled to said output of said bit load pick-up and an output;

a first multiplying circuit having inputs coupled to said output of said first divider and to said output of said non-linear member and an output coupled to said input of said first switching circuit;

said second channel comprising:

a first multiplying circuit having two inputs coupled to said output of said bit rotary speed pick-up and an output;

a second multiplying circuit having a first input coupled to said output of said first multiplying circuit, a second input coupled to said output of said bit rotary speed pick-up and an output;

a first adder having a first input coupled to said output of said second multiplying circuit, a second input coupled to said output of said bit rotary speed pick-up and an output;

a third multiplying circuit having a first input coupled to a respective output of said control board, a second input coupled to said output of said first adder and an output;

a first divider having a first input coupled to said output of said third multiplying circuit, a second input and an output;

a second adder having a first input coupled to a respective output of said control board, a second input and an output;

a fourth multiplying circuit having a first input coupled to said output of said second adder, a second input and an output coupled to said second input of said first divider;

a fifth multiplying circuit having inputs coupled to said output of said bit load pick-up and to a respective output of said control board, respectively, and an output coupled to said second input of said second adder;

a sixth multiplying circuit having a first input coupled to a respective output of said control board, a second input coupled to said output of said second forming unit for forming optimum control signals and an output;

a third adder having a first input to which is fed a bias voltage, a second input coupled to said output of said sixth multiplying circuit and an output coupled to said second input of said fourth multiplying circuit.

47. An apparatus according to claim 44, wherein said circuit for correcting the coefficient corresponding to the drillability of rock comprises:

a first logarithm-computing circuit having an output and input which is coupled to said output of said first memory;

a second logarithm-computing circuit having an output and an input coupled to said output of said monitoring unit for monitoring values of parameters;

a third logarithm-computing circuit having an output and an input which is coupled to said output of said overaging unit for discretely averaging drilling speed;

a fourth logarithm-computing circuit having an output and an input which is coupled to said output of said bit rotary speed pick-up;

first, second, third and fourth multiplying circuits each having a first input, a second input and an output, said first input of said first multiplying circuit being coupled to said output of said first logarithm-computing circuit, said first input of said third multiplying circuit being coupled to said output of said fourth logarithm-computing circuit, said first input of said second logarithm-computing circuit and said first and second inputs of said fourth multiplying circuit being coupled to said output of said first logarithm-computing circuit;

a first adder having a first input which is coupled to said output of said first multiplying circuit, a second input and an output;

a second adder having a first input to which is coupled said output of said second logarithm-computing circuit, a second input to which is coupled said output of said third logarithm-computing circuit and an output;

a switching circuit having an input coupled to said output of said second adder, a second input, a first output coupled to said second input of said first adder and a second output.

an inverter having an input coupled to said second output of said switching circuit and an output coupled to said third input of said first adder;

a third adder having a first input and a second input which are coupled to said respective outputs of said third and fourth multiplying circuits, respectively, and an output;

a divider having a first input coupled to said output of said second logarithm-computing circuit, a second input coupled to said output of said third adder and an output coupled to said second input of said switching circuit;

an antilograithm-computing circuit having an input coupled to said output of said first adder and an output which is the output of said circuit for correcting the coefficient corresponding to the drillability of rock.

48. An apparatus according to claim 44, wherein the circuit for correcting the coefficient corresponding to rotary speed comprises:

a first adder having a first input, a second input, a third input and an output, said first input of said first adder being coupled to said output of said first memory, said output of said first adder being the output of said circuit for correcting the coefficient corresponding to rotary speed;

a first logarithm-computing circuit having an input coupled to said output of said monitoring unit for monitoring values of coefficients and an output;

a second logarithm-computing circuit having an input coupled to said output of said averaging unit for discretely averaging drilling speed and an output;

a third logarithm-computing circuit having an input coupled to said output of said bit rotary speed pick-up and an output;

a fourth logarithm-computing circuit having an input coupled to said output of said first circuit for correcting the coefficient and an output;

a second adder having a first input and a second input which are coupled to said outputs of first and second logarithm-computing circuits, respectively, and an output;

a switching circuit having an input coupled to said output of said second adder, a first output coupled to said second input of said first adder and a second output;

an inverter having an input coupled to said second output of said switching circuit and an output coupled to said third input of said first adder;

first, second and third multiplying circuits each having a first input, a second input and an output, said first input of said first multiplying circuit being coupled to said output of said second adder, said second input of said first multiplying circuit and said first and second inputs of said second multiplying circuit being coupled to said output of said third logarithm-computing circuit, said first and second inputs of said third multiplying circuit being coupled to said output of said fourth logarithm-computing circuit;

a third adder having a first input and a second input coupled to said outputs of said second and third multiplying circuits and an output;

a divider having a first input coupled to said output of said first multiplying circuit, a second input coupled to said output of said third adder and an output coupled to said second input of said switching circuit.

49. An apparatus according to claim 44 wherein said control board comprises:

a plurality of code switches and a plurality of switches, and said entering unit for sequentially entering data comprises a group of electronic switches in a number enabling the entering of a desired number of data from said control board, each electronic switch of said group having an input coupled to a respective code switch of said plurality of switches and a control input coupled to a respective switch of said plurality of switches, and code-to-analog signal converters, the number of said converters corresponding to the number of electronic switches of said group, each converter being coupled to said respective electronic switch.

50. An apparatus according to claim 44, wherein said correcting unit for correcting coefficients of the adaptive model comprises a group of electronic switches having a common control input and each having an output, and a correcting value former having an input coupled to said outputs of said electronic switches and comprising a circuit for memorizing the signal and a signal tracing circuit each having an output which are the outputs of said correcting unit.

* * * * *